US009132896B2

(12) United States Patent
Snow

(10) Patent No.: US 9,132,896 B2
(45) Date of Patent: Sep. 15, 2015

(54) TRIM TAB

(71) Applicant: Marine 1, LLC, Commerce, MI (US)

(72) Inventor: Scott Snow, Commerce, MI (US)

(73) Assignee: MARINE 1, LLC, Commerce, MI (US)

( * ) Notice: Subject to any disclaimer, the term of this patent is extended or adjusted under 35 U.S.C. 154(b) by 0 days.

(21) Appl. No.: 13/837,557

(22) Filed: Mar. 15, 2013

(65) Prior Publication Data

US 2014/0190387 A1 Jul. 10, 2014

Related U.S. Application Data

(63) Continuation-in-part of application No. 13/709,476, filed on Dec. 10, 2012, now Pat. No. 8,707,884, which is a continuation of application No. 12/547,299, filed on Aug. 25, 2009, now Pat. No. 8,327,790.

(60) Provisional application No. 61/091,451, filed on Aug. 25, 2008.

(51) Int. Cl.
*B63B 1/22* (2006.01)
*B63B 39/06* (2006.01)

(52) U.S. Cl.
CPC ..... *B63B 39/061* (2013.01)

(58) Field of Classification Search
CPC ..... B63B 39/00; B63B 39/06; B63B 39/061; B63B 2039/00; B63B 2039/06; B63B 2039/068
USPC ..... 114/284–286; 440/38–41
See application file for complete search history.

(56) References Cited

U.S. PATENT DOCUMENTS

| | | | | |
|---|---|---|---|---|
| 5,310,369 | A | 5/1994 | Kobayashi | |
| 5,881,666 | A | 3/1999 | Crews, Jr. | |
| 6,089,177 | A | 7/2000 | Muller | |
| 6,524,146 | B2 * | 2/2003 | Spade et al. | 440/41 |
| 7,174,843 | B1 | 2/2007 | Tossavainen | |
| 8,327,790 | B2 * | 12/2012 | Snow | 114/285 |
| 8,707,884 | B2 * | 4/2014 | Snow | 114/285 |
| 2005/0126466 | A1 | 6/2005 | Moore et al. | |
| 2014/0190388 | A1 | 7/2014 | Snow | |

FOREIGN PATENT DOCUMENTS

| | | | |
|---|---|---|---|
| DE | 19753926 | C1 | 5/1999 |
| DE | 19837888 | C1 | 2/2000 |
| JP | H06037200 | A | 2/1994 |

(Continued)

OTHER PUBLICATIONS

International Search Report and Written Opinion for PCT Application No. PCT/US2009/054902 mailed Apr. 2, 2010; 8 pages.

*Primary Examiner* — Daniel V Venne

(57) ABSTRACT

A trim tab assembly includes a trim tab and a support structure. The trim tab includes first and second ends. The first end includes a member or a curved surface. The member or the curved surface, when in an extended state, adjusts motion of a marine vessel. The second end attaches to the marine vessel via an attachment device. The member or the curved surface is convex-shaped such that the member or the curved surface curves outward in a direction away from the attachment device. The support structure attaches to the marine vessel. The support structure includes a scraper plate. The scraper plate is adjacent the member or the curved surface. The member or the curved surface moves relative to the scraper plate while transitioning between a retracted state and the extended state.

20 Claims, 23 Drawing Sheets

(56) References Cited

FOREIGN PATENT DOCUMENTS

| | | | |
|---|---|---|---|
| JP | H07165185 | A | 6/1995 |
| JP | 2001294197 | A | 10/2001 |
| WO | WO-98/24684 | A1 | 6/1998 |
| WO | WO-2010/027791 | A2 | 3/2010 |

* cited by examiner

TRIM TAB

CROSS-REFERENCE TO RELATED APPLICATIONS

This application is a continuation-in-part of U.S. application Ser. No. 13/709,476, filed on Dec. 10, 2012 (now U.S. Pat. No. 8,707,884), which is a continuation of U.S. application Ser. No. 12/547,299, filed on Aug. 25, 2009 (now U.S. Pat. No. 8,327,790). U.S. application Ser. No. 12/547,299 claims priority to U.S. Provisional Application No. 61/091,451 filed Aug. 25, 2008. The entire disclosures of the applications referenced above are incorporated herein by reference.

FIELD

The disclosure relates to trim tabs for marine vessels

BACKGROUND

Generally, prior art trim tabs produce larger lift forces when compared to prior art interceptor tabs having identical span; approximately 60% more lift at maximum deployment according to one study. This property is important in the context of stabilization systems. Trim tabs have greater vessel attitude control authority because they generate larger rotational pitch and roll forces (moments) when compared to interceptor tabs. However, the primary disadvantage associated with prior art trim tabs involves actuation force. Compared to interceptor tabs, trim tabs require substantially more force to actuate, particularly at higher vessel speeds. There is therefore a need in the art for an improved tab design which solves prior art deficiencies by combining the higher overall lift performance characteristic of trim tabs with the low actuation force characteristic of interceptor tabs

SUMMARY

A trim tab assembly is provided and includes a trim tab and a support structure. The trim tab includes first and second ends. The first end includes a member or a curved surface. The member or the curved surface, when in an extended state, adjusts motion of a marine vessel. The second end attaches to the marine vessel via an attachment device. The member or the curved surface is convex-shaped such that the member or the curved surface curves outward in a direction away from the attachment device. The support structure attaches to the marine vessel. The support structure includes a scraper plate. The scraper plate is adjacent the member or the curved surface. The member or the curved surface moves relative to the scraper plate while transitioning between a retracted state and the extended state.

In other features, a trim tab is provided and includes a member, a first end, and a second end. The member is connected to and positioned at least partially forward of an attachment device. The member rotates at least partially about a portion of the attachment device between a retracted state and an extended state to adjust motion of a marine vessel. The first end includes a first portion and a second portion. The first end is positioned forward of the second end. The second portion of the first end extends forward of the first portion of the first end and away from the second end. While in the extended state, the first end extends at least from a first point, adjacent a scraper plate or a bottom surface of the marine vessel, to a second point below the scraper plate or the bottom surface of the marine vessel.

In other features, a trim tab is provided and includes a first end, a second end and a side. The first end includes a first member. The first member has a first curved surface. The second end attaches to a marine vessel via an attachment device. The first end adjusts motion of the marine vessel. The side extends between the first member and the attachment device. The first curved surface and the side define a wedge-shaped portion of the trim tab. The first member is pivoted about a portion of the attachment device and extends below a scraper plate or a second surface of the marine vessel while in an extended state.

In one aspect there is disclosed a trim tab assembly for a watercraft. The trim tab assembly includes a support structure attached to the watercraft. At least one trim tab is pivotally attached to the support structure. An actuator is connected to the trim tab pivotally moving the trim tab relative to the support structure. The at least one trim tab includes a curved surface positioned to contact water when the watercraft is in motion.

In a further aspect, there is disclosed a trim tab assembly for a watercraft. The trim tab assembly includes a support structure attached to the watercraft. At least one trim tab is pivotally attached at a rear of the trim tab using a hinge to the support structure. An actuator is connected to the trim tab pivotally moving the trim tab relative to the support structure In another aspect, there is disclosed a trim tab assembly for a watercraft. The trim tab assembly includes a support structure attached to the watercraft. A trim tab mounting frame is pivotally attached to the support structure. At least one trim tab is pivotally attached to the trim tab mounting frame. A first actuator is connected to the trim tab pivotally moving the trim tab relative to the trim tab mounting frame. A second actuator is connected to the trim tab mounting frame pivotally moving the trim tab mounting frame wherein an angle of deflection of the trim tab relative to ambient water flow is adjusted

DETAILED DESCRIPTION

Differential and differentially are defined within this document as unequal, off center and/or involving differences in: angle, speed, rate, direction, direction of motion, output, force, moment, inertia, mass, balance, application of comparable things, etc.

Dynamic and dynamically may be defined as the immediate action that takes place at the moment they are needed. Immediate, in this application, means that the control action occurs in a manner that is responsive to the extent that it prevents or mitigates vessel motions and attitudes before they would otherwise occur in the uncontrolled situation. Someone skilled in the art understands the relationship between sensed motion parameters and required effector response in terms of the maximum overall delay that can exist while still achieving the control objectives. Dynamic may be used in describing interactive hardware and software systems involving differing forces and may be characterized by continuous change and/or activity. Dynamic may also be used when describing the interaction between a vessel and the environment. As stated above, marine vessels may be subject to various dynamic forces generated by its propulsion system as well as the environment in which it operates.

A vessel attitude may be defined as relative to three rotational axes including pitch attitude or rotation about the Y, transverse or sway axis, roll attitude or rotation about the X, longitudinal or surge axis, and yaw attitude or rotation about the Z, vertical or heave axis Someone skilled in the art understands that active marine vessel damping is the attenuation of the value of a resonant response, such as the pitch, roll and yaw of the vessel. Someone skilled in the art understands that a marine vessel active stabilization, motion damping and attitude control system is a system selected, sized and integrated, based on a vessel's specific design, to achieve the effector rates required for damping pitch and/or roll and/or yaw.

Someone skilled in the art understands, for motion damping to be achieved, effector angular motion rates may generally be at least 10 times the vessel angular motion rate in the pitch and roll axes. For example, angular motion rates of 4 degrees per second may be typical of conventional high performance planning craft. This means that effector angular motion rates of 40 degrees per second may be used to achieve motion damping for this specific performance class of planing craft.

Someone skilled in the art understands, a hydrofoil, planing device and/or interceptor produces control forces based on a speed-squared relationship and are therefore much more effective at higher speeds than lower speeds. For example, a trim tab produces 4 times the amount of force at 20 knots than it does at 10 knots.

Figure 3:
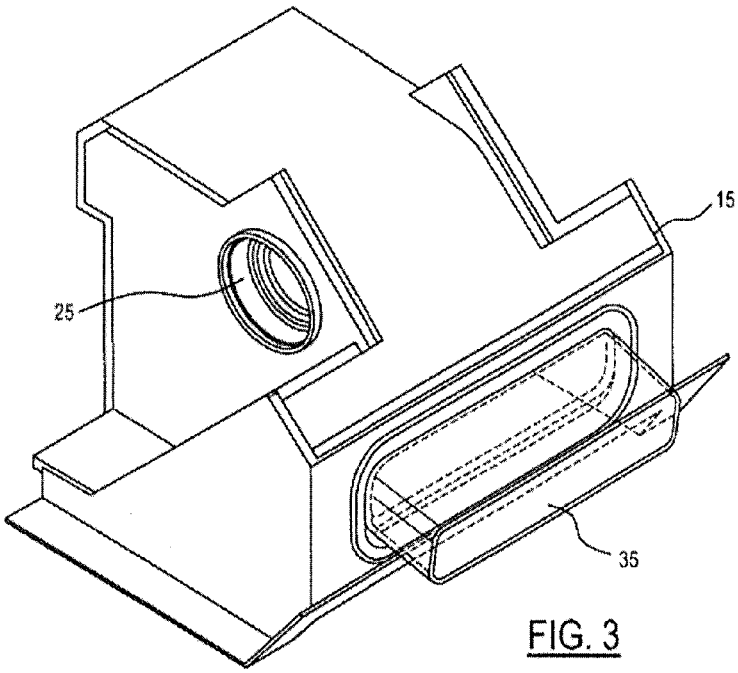
FIG. 3 is a perspective view of an enclosure for a trim tab assembly for a watercraft FIG. 3.

Referring to the figures, there is shown a trim tab assembly 10 for a watercraft. The trim tab assembly 10 may include an enclosure 15 or shell structure, as best shown in FIG. 3. The enclosure 15 may be linked with or joined with a support structure 30, to form a module that may be positioned within a hole formed in a watercraft. Alternatively, the enclosure 15 may be an opening formed within the hull in which the support structure 30 is disposed. Alternatively, the tab assembly 10 may be modular within a self-contained structure that may be attached to a vessel. At least one trim tab 20 is disposed within the enclosure 15. An electric actuator 22 may be linked with the trim tab 20 pivotally moving the trim tab 20 relative to the enclosure 15. The electric actuator 22 may be positioned on a dry side not exposed to water relative to the enclosure 15

Referring to FIG. 3, there is shown one embodiment of an enclosure 15 for use in the trim tab assembly 10. As can be seen in the figure, the enclosure 15 is sized and shaped to accommodate the trim tab assembly 10. The enclosure 15 may include holes 25 formed therein for accommodating various components of the trim tab assembly 10, as will be discussed in more detail below. Additionally, the enclosure 15 may also include a pressure relief orifice 35 formed therein that allows for release of air and water pressure created by movement of the trim tab 20 within the enclosure 15 during actuation Referring to the figures, the trim tab assembly 10 may include an electric actuator 22 having a driveshaft 40 that is connected to a drive gear 45. At least one bearing 50 supports the driveshaft 40 in the support structure 30. In one aspect, the at least one bearing 50 includes a seal 55 preventing water disposed within the enclosure 15 from exiting the cavity 15. Additionally, the seal 55 isolates the electric actuator 22 that is positioned on a dry side of the enclosure 15 from the water. A position sensor 89 best seen in FIGS. 10, 11 and 12-16 may be attached to the drive shaft 40 to monitor a position of the trim tab 20 relative to the enclosure 15. The position sensor 89 may include a potentiometer or equivalent device used to communicate position data to a central control computer. Alternatively, the electric actuator 22 may include a position sensor integrated with the motor.

Again referring to figures, the trim tab assembly 10 may include a driven member 60 that is attached to the trim tab 20 and is operably linked with the drive gear 45. In one aspect, the driven member 60 may include a flexible gear portion 65 attached to the driven member 60 and is meshed with the drive gear 45. In one aspect, the interface between the drive gear 45 and driven member 60 is a soft interface such that the gear teeth of the flexible gear portion 65 will shear upon application of a predetermined force preventing damage to a gearbox 70 of the electric actuator 22 as well as the driveshaft 40 and enclosure 15. It should be realized that the gear box may be eliminated as a separate component and may be integrated with the electric actuator 22. Additionally, the soft interface provides a joining of the drive gear 45 and driven member 60 without the need for lubrication. Such a dry relationship is advantageous when used in a wet environment within the enclosure 15

Figure 5:
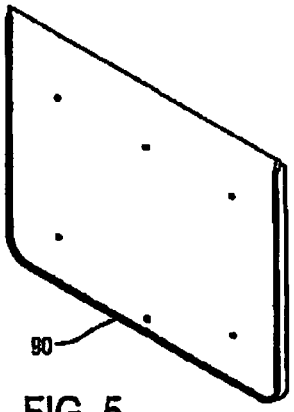
FIG. 5 is a view of a removable plate for attaching to a bottom surface of a trim tab.
Figure 9:
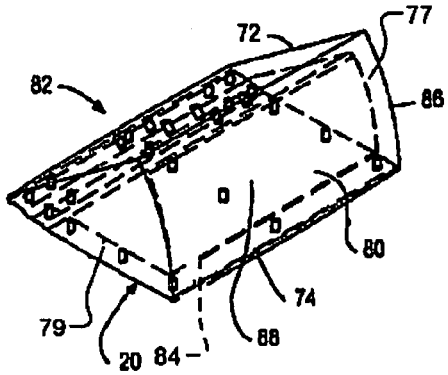
FIG. 9 is a view of the trim tab.
Figure 10:
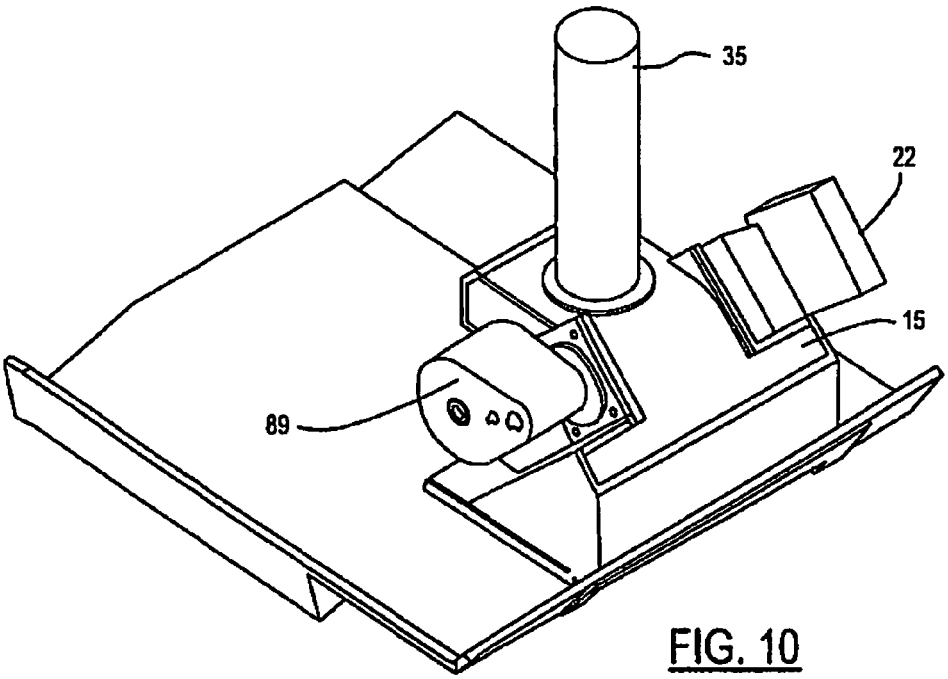
FIG. 10 is an alternate embodiment of an enclosure having a pressure relief orifice.
Figure 11:
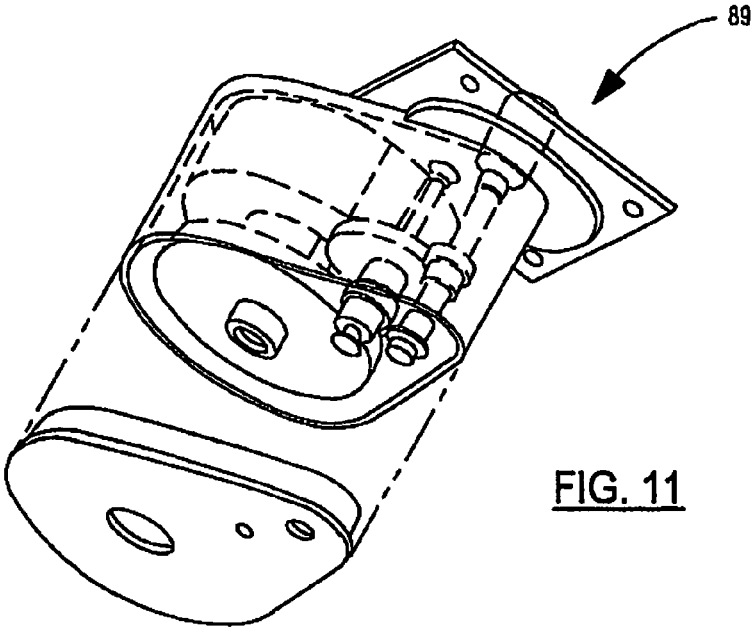
FIG. 11 is a view of a position sensor.
Figure 12:
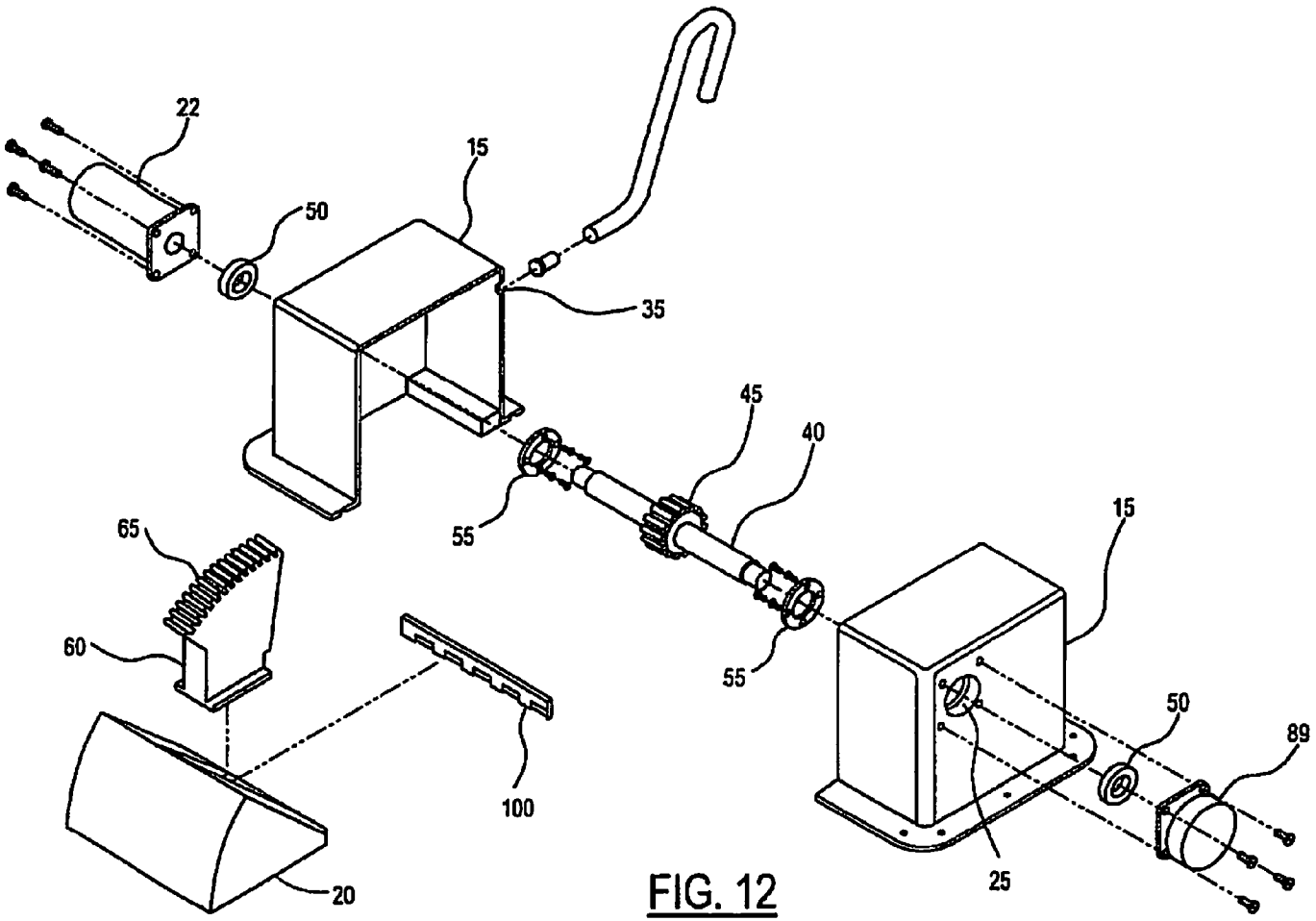
FIG. 12 is an exploded perspective view of the alternate embodiment of FIG. 4.
Figure 13:
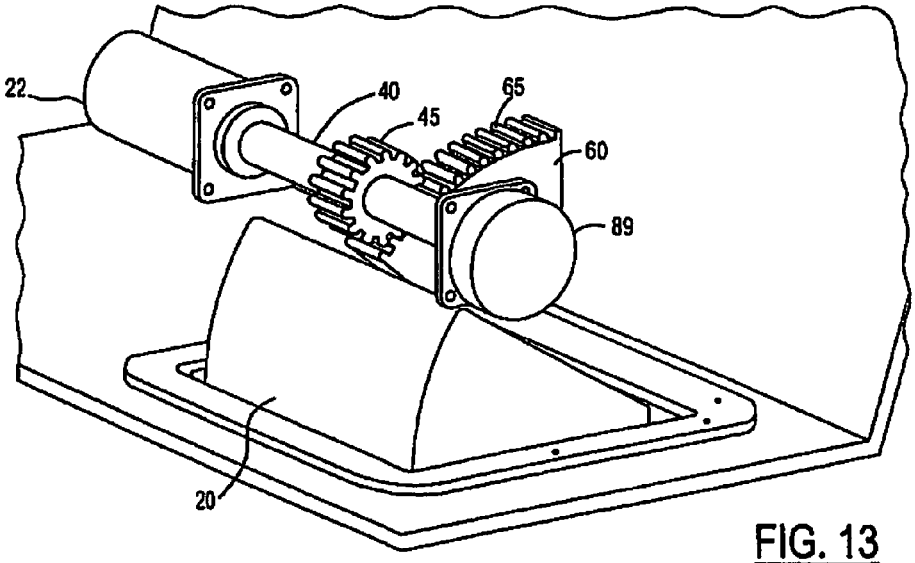
FIG. 13 is a perspective view of the alternate embodiment of FIG. 12 with the tab in the non-deployed position.
Figure 14:
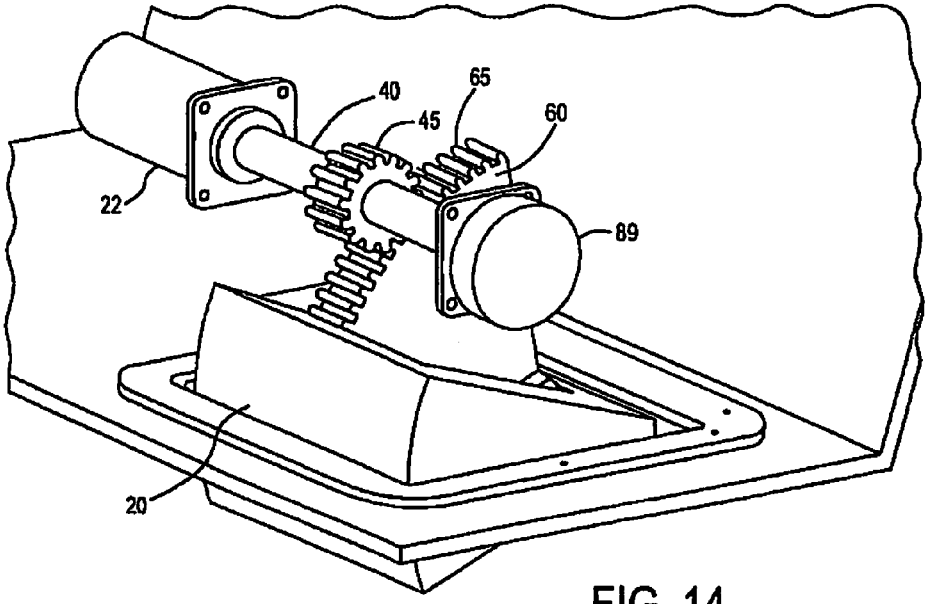
FIG. 14 is a perspective view of the alternate embodiment of FIG. 12 with the tab in an intermediate position.
Figure 15:
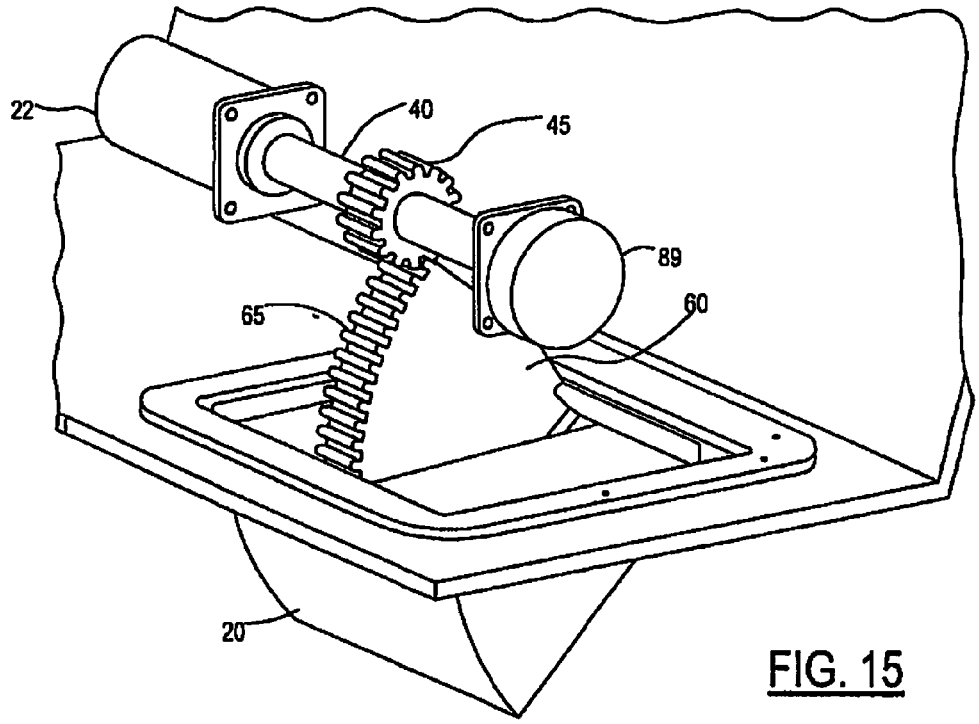
FIG. 15 is a perspective view of the alternate embodiment of FIG. 12 with the tab in the fully deployed position.
Figure 16:
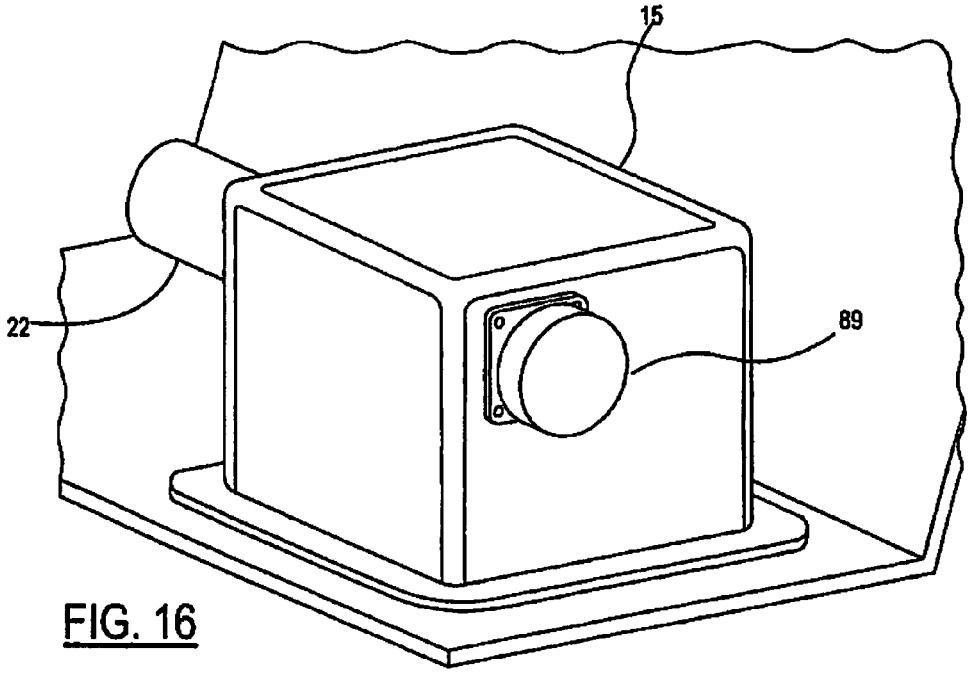
FIG. 16 is a perspective view of the alternate embodiment of FIG. 12 with the enclosure shown.

Referring to the various figures, in one aspect the trim tab 20 may include a generally planar top 72, bottom surface 74, and side surfaces 76 linked by a curved forward facing (or first) surface 80 defining a wedge-shaped body 82. In one aspect, as best seen in FIG. 9, the trim tab 20 may include an inner support structure 84 surrounded by an outer skin 86. The trim tab 20 may include: a first end 71 having a curved (or first) member 73 with the curved forward facing surface 80; a second end 75; a side (or second) member 77; and a side (or third) member 79. The first member 73 may have a top (or third) end 81 and a bottom (or fourth end) 83 with a bottom surface 91. The trim tab 20 may also include a side (or bottom) surface 87. The curved forward facing surface 80 and the member 73 extend outward from the hinge assembly 100 and upward from the fourth end 83 to the third end 81. In one aspect, the wedge shaped body 82 may include a buoyant material positioned within an interior 88 of the wedge-shaped body 82 providing support for the outer skin 86 as well as decreasing an overall weight of the trim tab 20. Various materials such as closed and open cell foams may be used in conjunction with additional support structure to withstand loads applied to a trim tab 20 during actuation and to provide buoyancy In another aspect, and as shown in FIG. 5, a removable plate 90 may be attached to a water contacting surface of the trim tab 20. The removable plate 90 may include characteristics for modifying the performance characteristics of the trim tab 20. For example, the removable plate 90 may have various characteristics including concave shapes, convex shapes, and strakes of varying dimension and position, as well as shape surfaces that match the contour of a watercraft hull. In this manner, the removable plate 90 may be tailored to provide various design and performance characteristics that affect the overall performance of a watercraft having a trim tab assembly 10. Additionally, the removable plate 90 can be swapped out with another plate to provide various configurations that may be interchangeable to affect the performance of a watercraft.

Figure 1:
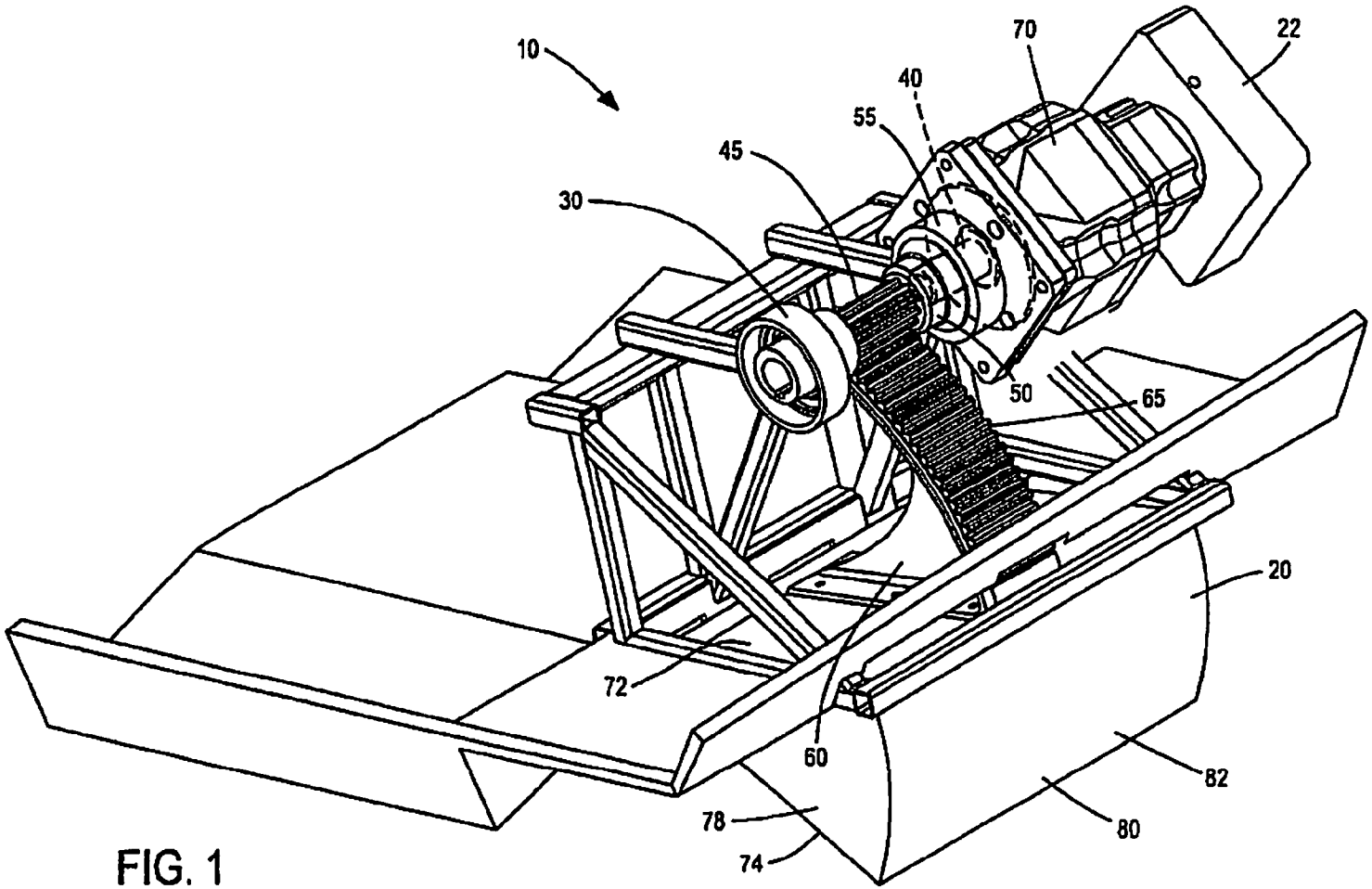
FIG. 1 is a partial perspective view of a trim tab assembly for a watercraft having a trim tab in a deployed position.
Figure 2:
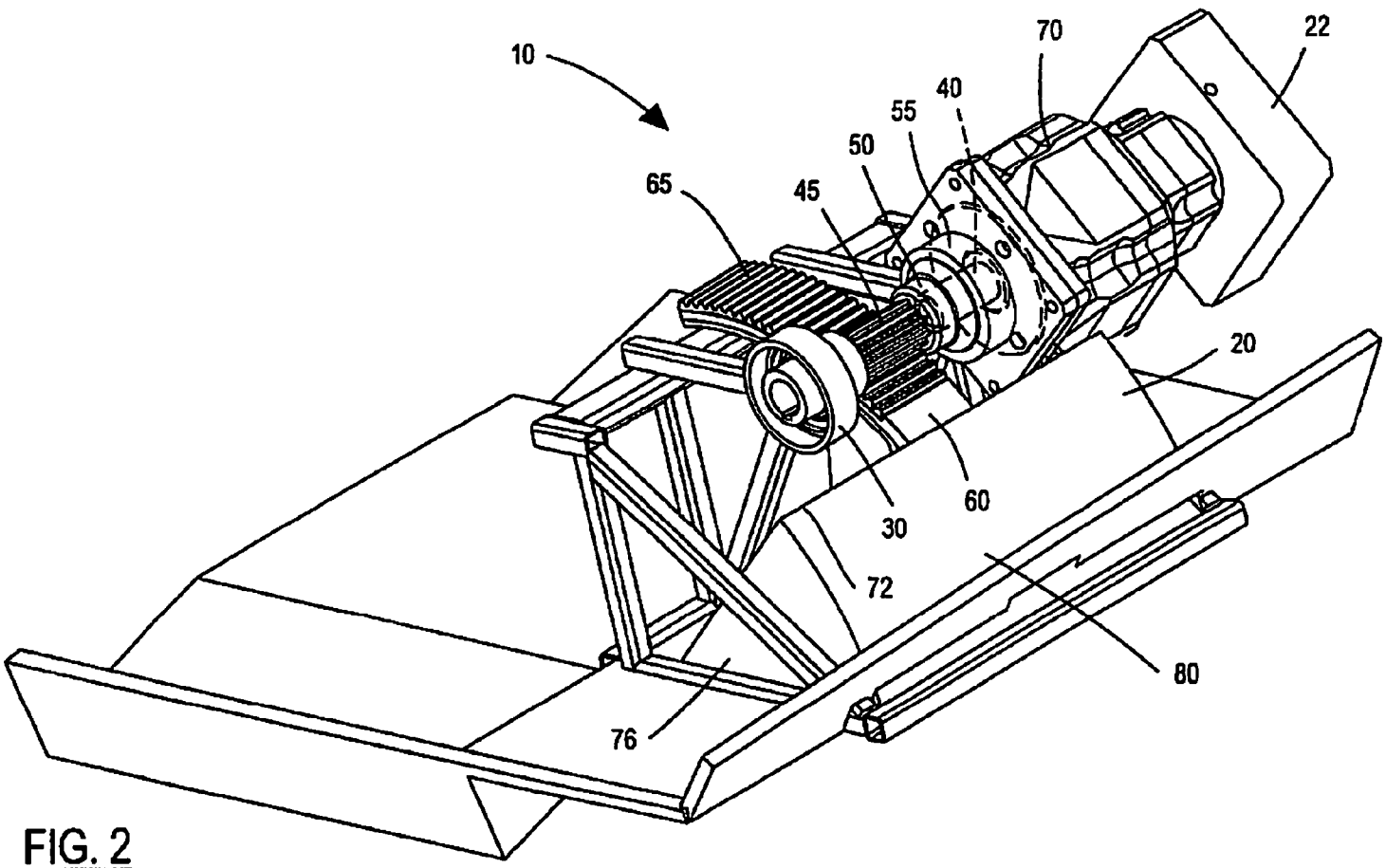
FIG. 2 is a partial perspective view of a trim tab assembly for a watercraft having a trim tab in a stowed position.
Figure 6:
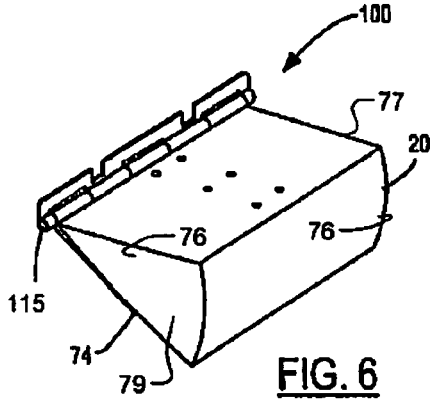
FIG. 6 is a view of the trim tab and a hinge assembly.
Figure 7:
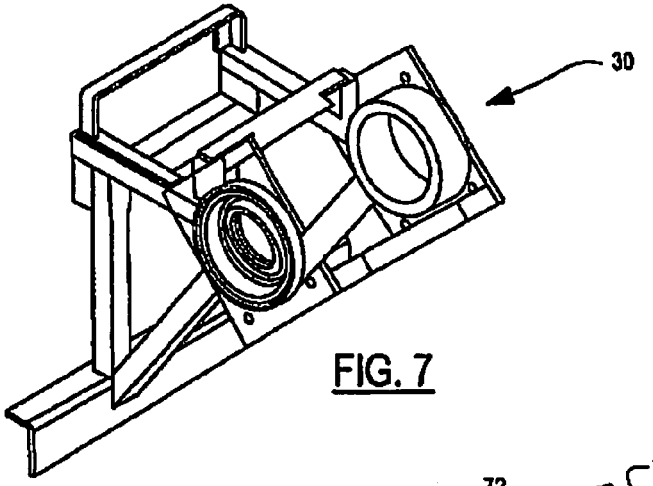
FIG. 7 is a view of the support structure.
Figure 8:
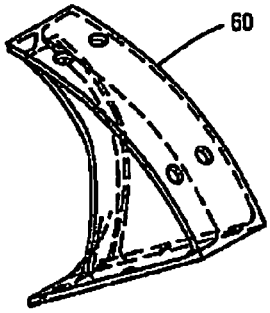
FIG. 8 is a view of the driven member.

Referring to FIGS. 1, 2 and 6, the trim tab assembly 10 may include a hinge assembly 100 that is linked to the enclosure 15 and the trim tab 20 for pivotal movement of the trim tab 20 relative to the enclosure 15. As shown in FIGS. 1 and 2, the hinge assembly 100 may be positioned on a forward edge of the enclosure 15 and linked with a forward portion of the trim tab 20. In one aspect, the hinge assembly 100 may be in two pieces such that one piece is attached to a bottom surface 74 of the trim tab 20 at a forward edge and is mated with a second piece attached to the support structure 30 disposed within the enclosure 15. A hinge pin 115 may be positioned along a center line of the hinge allowing pivotal movement of the trim tab 20 relative to the support structure 30 and enclosure 15.

In one aspect, the trim tab 20 may be positioned within the enclosure 15 in a close tolerance relationship preventing high pressure water created during tab deflection or extension from entering the enclosure 15. In this manner, high pressure water is prevented from contacting a low pressure top surface 72 of the trim tab 20 that is disposed within the enclosure 15. In one aspect, the trim tab 20 remains at least partially within the enclosure 15 when fully deployed to prevent foreign objects from entering the enclosure 15.

In use, the trim tab 20 is pivotally movable within the enclosure 15 to apply deflection forces to the water or obstruction of the water on which a watercraft is traveling to affect the performance of the watercraft. In one aspect, the trim tab 20 is actuated at speeds sufficient to counter motion rates and damp motion in a pitch, roll and yaw axis of the watercraft. In one aspect, the trim tab 20 is actuated to control attitude changes in a pitch, roll and yaw axis of the watercraft.

In one aspect, the watercraft may include at least two trim tab assemblies 10 positioned within the watercraft. The trim tab assemblies 10 may be actuated in series, meaning that the at least two trim tab assemblies 10 actuate in the same manner at a given time, Alternatively, the at least two trim tab assemblies 10 may be actuated differentially wherein actuation of one of the trim tabs 20 is not the same as another to affect various forces on the watercraft to control the attitude, motion and motion damping in the axes, as described above.

Referring to FIGS. 4 and 12-16, there is shown an alternate embodiment of a trim tab assembly 10 including the same components described above except that the curved surface 80 of the trim tab 20 is positioned within the enclosure 15 in a forward facing position relative to the watercraft. The first member 73 is pivoted about a portion 121 and a center (or center point) 111 of the hinge assembly 100 from a fully retracted position to a fully deployed position.

Figure 4:
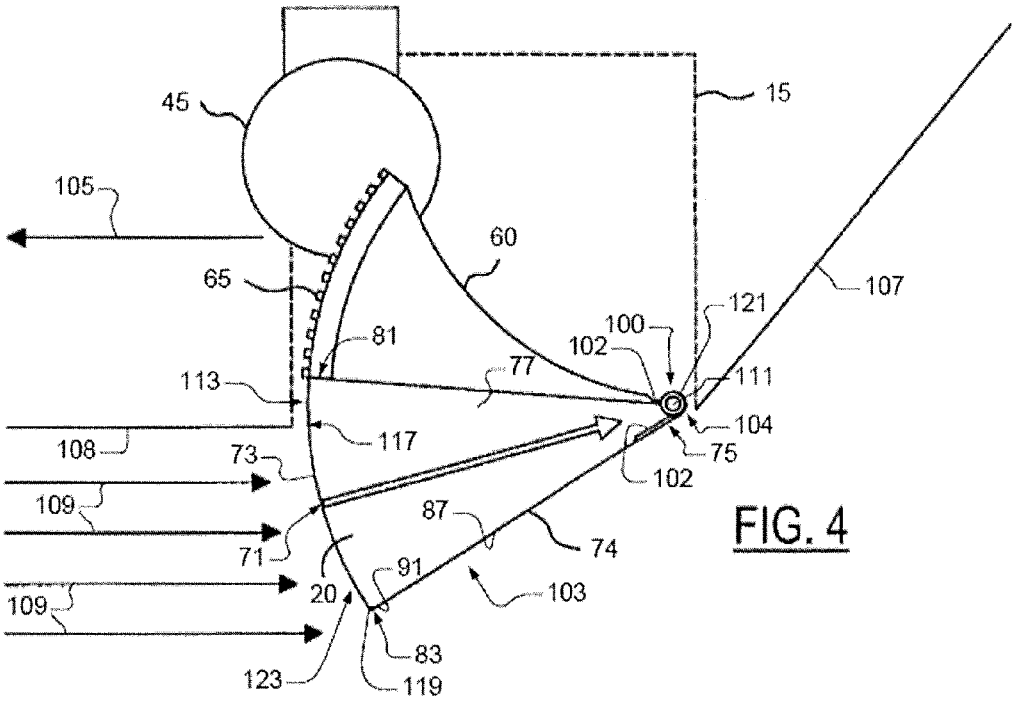
FIG. 4 is a view of an alternate embodiment of a trim tab assembly with a forward facing curved leading edge and its hinge placed aft.

The first member 73 and the trim tab 20 are shown in an example fully extended (or deployed) state 103. The first member 73 is in an upright position during transitioning of the trim tab 20 between the fully retracted state and the fully extended (or deployed) state, because, during the transition, the third end 81 is above the fourth end 83. While being deployed (or in a deployed state), (i) the third end 81 is higher than the fourth end 83. Arrow 105 indicates motion of the marine vessel 107. The marine vessel 107 has a second (or bottom) surface 108. While in the extended (or deployed) state 103, a first portion 113 of the first member 73 is not below the second surface 108, as shown in FIG. 4. A second portion 123 of the first member 73 extends forward of the first portion 113 and away from the second end 75, also as shown in FIG. 4. While in state 103, the first end 71 extends at least from a first point 117, adjacent the bottom surface 108 of the marine vessel 107, to a second point 119 below the bottom surface of the marine vessel 107, also as shown in FIG. 4. Arrows 109 indicate motion of oncoming water relative to the marine vessel 107.

Additionally, the hinge assembly 100, as described above, would be positioned at a rear edge 102 of the bottom surface 74 of the trim tab 20 and a rear 104 of the support structure 30 disposed within the enclosure 15. In this embodiment, the curved surface 80 contacts the water when actuated applying a force to the water and affecting a performance characteristic of a watercraft. In this position, the force needed to actuate the trim tab 20 is decreased in relation to the previously described first embodiment.

As described above and as shown in the figures, the trim tab assembly 10 may include attachment devices. One attachment device (i.e. the actuator 22) is shown in FIG. 1. Another attachment device (i.e. the hinge assembly 100) is shown in FIG. 4. The hinge assembly 100 may include brackets 102 and/or a shaft 104. The member 73, by being convex-shaped and by extending downwardly into and deflecting oncoming water, adjusts motion of the marine vessel 107, such as roll, pitch, and/or yaw motion of the marine vessel 107.

Accordingly, the present disclosure includes a trim tab system with both high-lift and low actuation force performance characteristics. Trim tab assemblies 10, 110 may include curved forward deflection surfaces and aft-hinge designs.

Prior art interceptor tabs are specifically designed to "intercept" flow within a vessel's boundary layer. In general, interceptor tabs perform best in the high-speed/planing regime. Conversely, their stabilization performance at low to transitional planing speeds, typically below 18 knots, is not especially good. In contrast, the trim tab assemblies 10, 110 perform exceptionally well at high-speed, and have significant control authority below 18 knots. The disclosed curved forward face transitions from interceptor tab-like qualities to trim tab-like qualities as it extends (interceptor tab-like within a vessel's boundary layer and trim tab-like outside a vessel's boundary layer). This design feature provides greater range of lift force production over a vessel's entire speed regime (slow, medium and high). The trim tab assemblies perform like a conventional tab at low-to-medium speeds, and like an interceptor tab at higher speeds.

In general, there is a direct relationship between vessel speed, deflection angle, and the force required to actuate a prior art trim tab. For example increasing vessel speed increases the force required to deflect a trim tab. Prior art trim tabs are hinged forward of the trim tab's deflection surface. As a consequence, prior art trim tab actuators burden substantial forces working against the tab during operation. For example, the forces on prior art trim tabs can be thousands of pounds depending on the tab's surface area, deflection angle and vessel speed. In contrast, the aft hinge designs associated with the disclosed trim tab assemblies receive most of the load; regardless of tab surface area, tab deflection, and vessel speed.

In FIGS. 17-22, another alternative embodiment of the trim tab assembly 110 for a watercraft is shown. The trim tab assembly 110 includes a support structure 115 attached to the watercraft. At least one trim tab 120 is pivotally attached to the support structure 115. An actuator 125 is connected to a trim tab 120 and pivotally moving the trim tab 120 relative to the support structure 115. In one aspect, the at least one trim tab 120 includes a trim tab frame 135 having a curved surface 140 positioned to contact water when the watercraft is in motion.

In one aspect, the actuator 125 may be a linear actuator connected directly to the trim tab frame 135. The connection may include a clevis and joint linking the actuator 125 to the frame 135. Various linear actuators may be utilized including hydraulic, pneumatic, or electric actuators. In one aspect, the actuator 125 may include an actuator mounting assembly 126 that includes the actuator 125. A bearing 116 is removably attached to the actuator 125. A bearing plate 118 having a hole 122 formed therein receives the bearing 116. A bearing mounting plate 124 also including a hole 126 formed therein that receives the bearing 116. First and second bearing inserts 128, 130 are removably disposed about the holes 122, 126 formed in the bearing plate 118 and the bearing mounting plate 124. The bearing mounting plate 124 and bearing plate 118 are coupled together to retain the bearing 116 and bearing inserts 128, 130 between the two components. The actuator 125 is angularly movable about the bearing 116.

Alternatively, the actuator 125 may include rotary type actuators, as described above with the previous embodiments. The rotary actuators may include a drive shaft connected to a drive gear and a driven member attached to the trim tab 120 and operatively linked with the drive gear such that the driven member includes a flexible gear portion meshed with the drive gear. In another aspect, the actuator 125 may include a through hole drive gear that is smaller than a drive shaft diameter to accommodate installation through bearings.

The support structure 115 may include multiple hinge locations 145 pivotally attaching the trim tab 120 to the support the trim tab frame 135 at various locations such that an angle of the trim tab 120 may be adjusted relative to the watercraft and water. As can be seen in the figures, the trim tab 120 may be pivotally attached at either the upper or lower hinge locations 145 on the support structure 115. It should be realized that various numbers of hinge locations 145 may be provided such that the angle of the trim tab 120 relative to the watercraft may be adjusted over a range.

Again referring to FIGS. 17-22, the trim tab frame 135 may include a cylindrical hinge structure 150 that receives a pivot shaft 155 that connects with bearings 160 and is received in journals 165 formed on the support structure 115.

As stated above, the trim tab frame 135 includes a curved surface 140 that is positioned to contact water when the watercraft is in motion. Various trim tab frames 135 may be utilized. In one aspect, the trim tab frame 135 may include a generally planar top 175, bottom 180 and side surfaces 185 linked by the curved surface 140 to define a wedge shaped trim tab body. Several of the top surface 175, bottom surface 180, and side surfaces 185 may include slots formed therein as detailed in the FIGS. 17-22 to lessen a weight of the trim tab assembly 110 and/or to allow relief of pressure applied to the tab assembly 110, and/or to reduce resistance to movement experienced by the tab assembly 110 resulting from its operation in water and/or other fluid.

Figure 17:
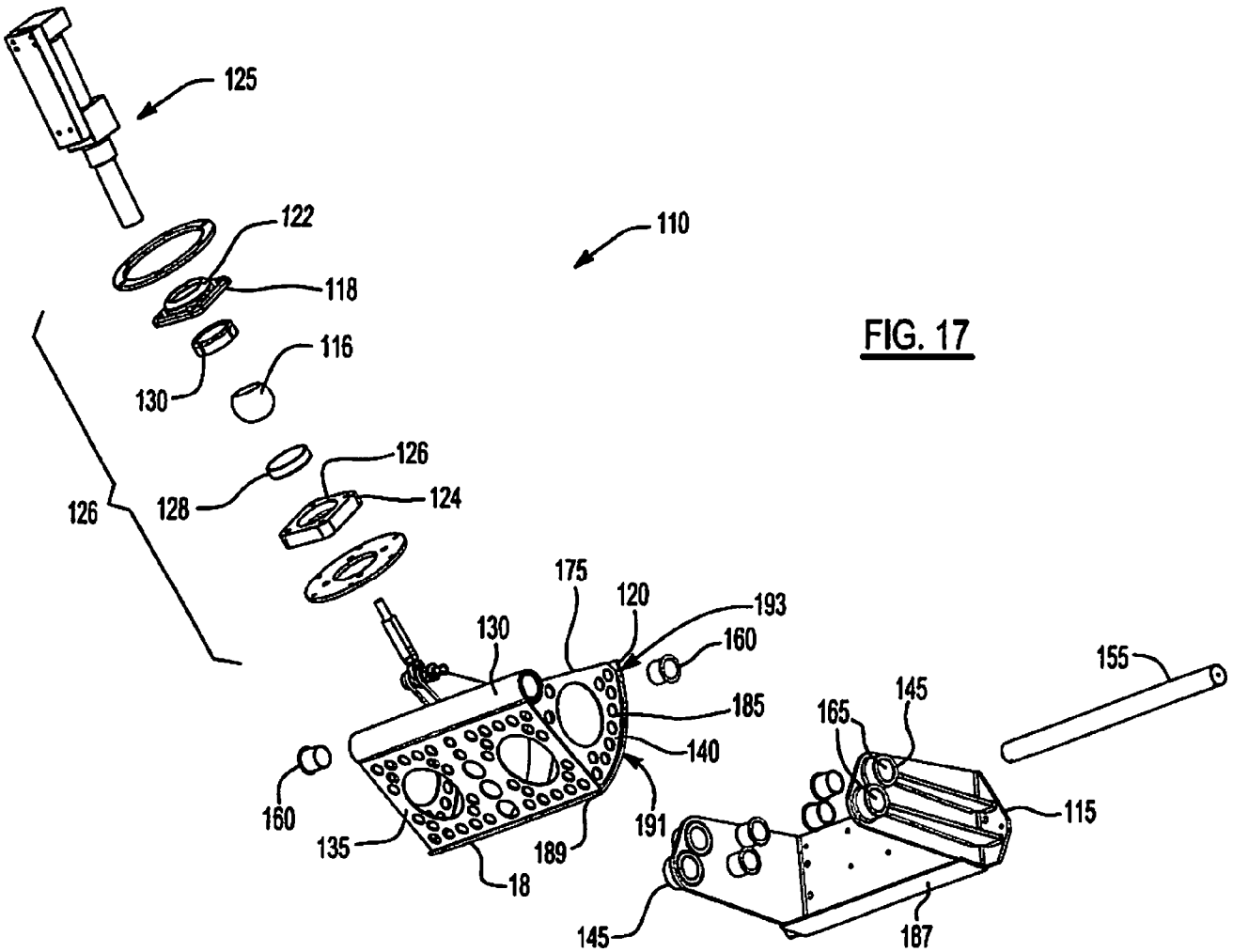
FIG. 17 is an exploded perspective view of another alternative embodiment of a trim tab assembly.
Figure 18:
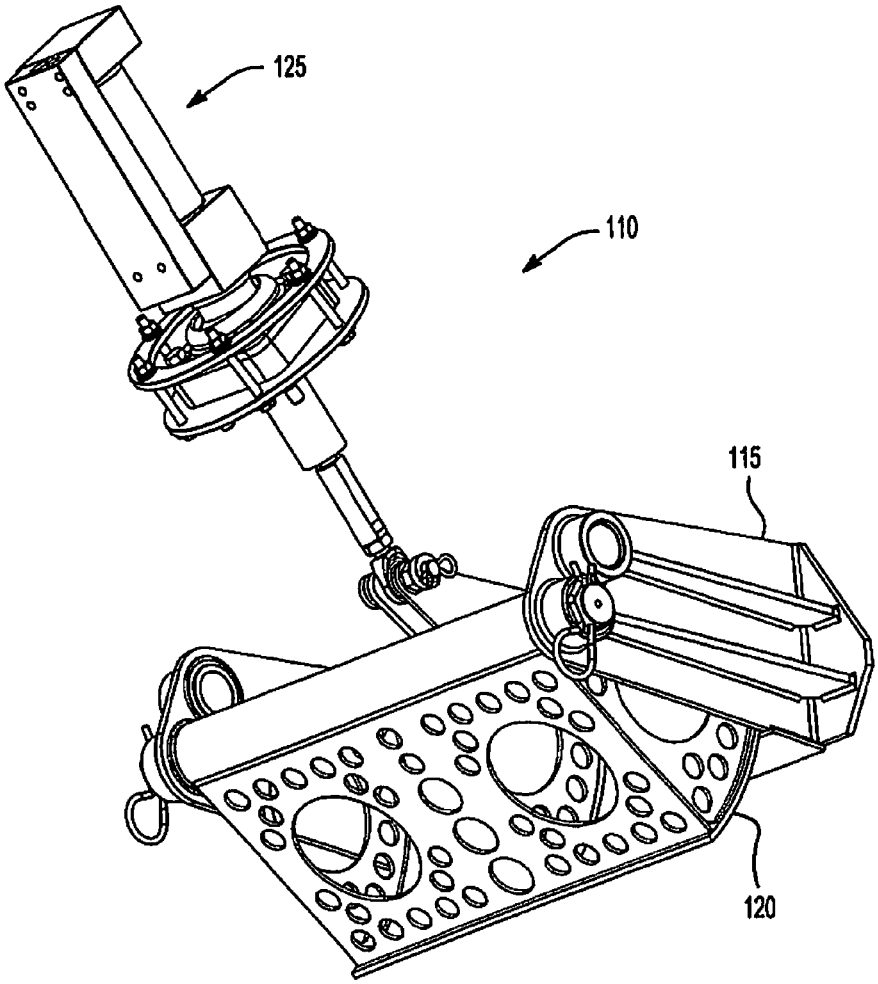
FIG. 18 is an assembled perspective view of the embodiment of FIG. 17.
Figure 19:
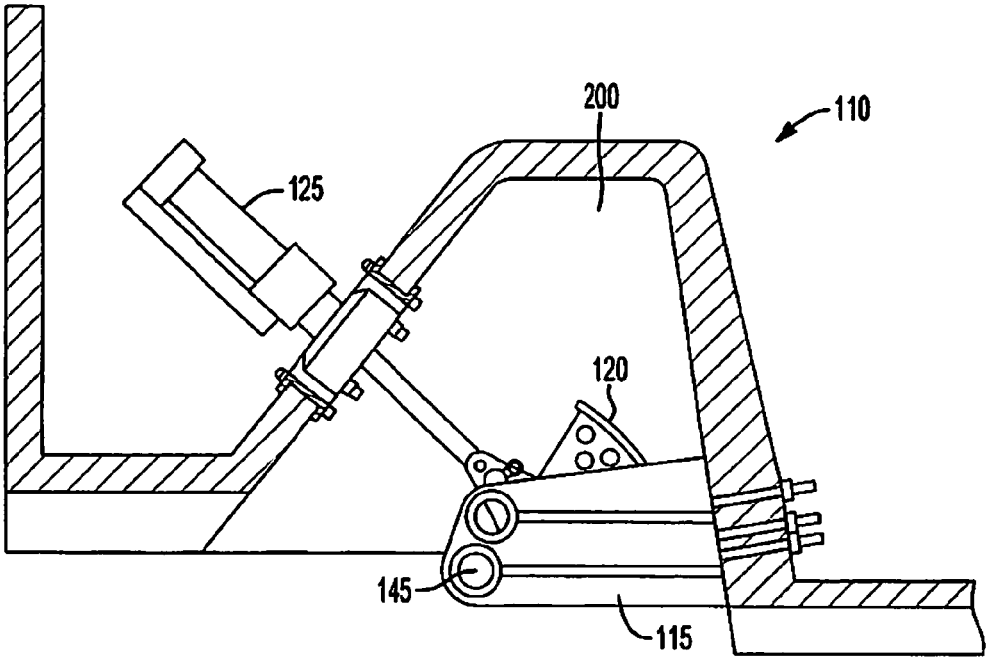
FIG. 19 is a partial side sectional view of the trim tab assembly of FIG. 17 installed in a cavity of a watercraft with a trim tab in a retracted position.
Figure 20:
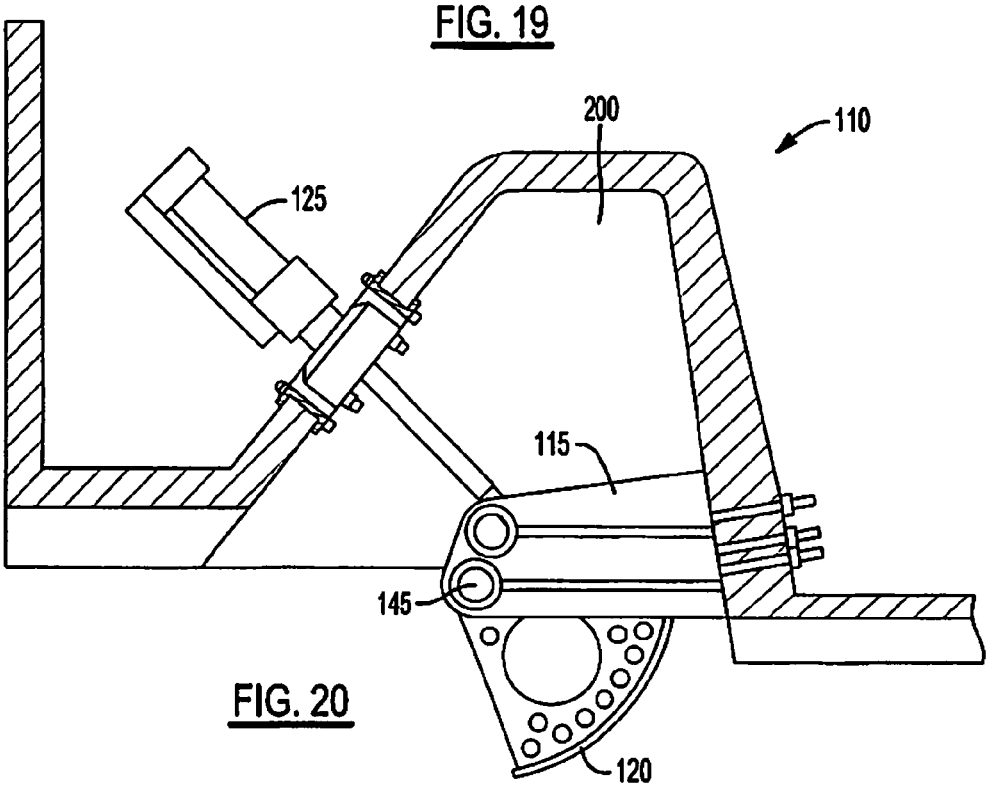
FIG. 20 is a partial side sectional view of the trim tab assembly of FIG. 17 with the trim tab in an extended position.
Figure 21:
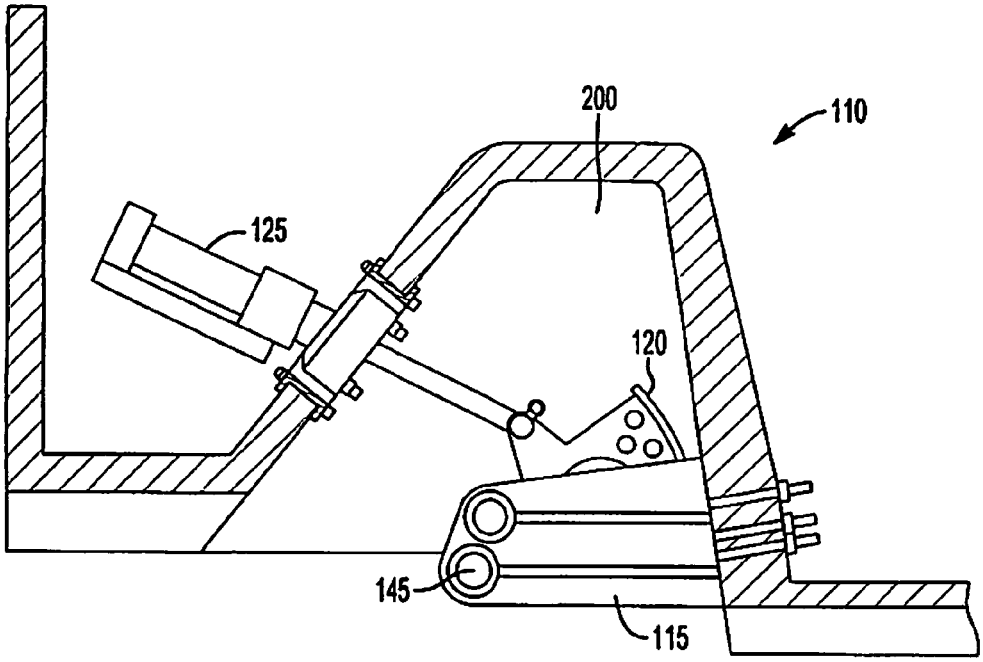
FIG. 21 is a partial side sectional view of the trim tab assembly of FIG. 17 with the trim tab in a retracted position and in an alternate hinge position.
Figure 22:
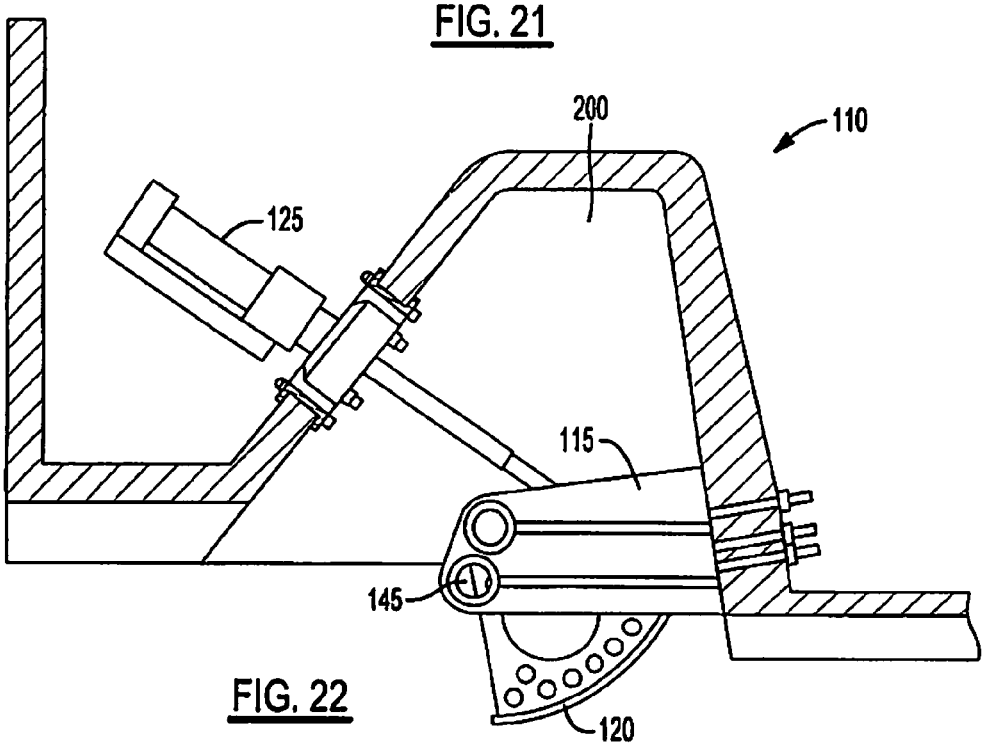
FIG. 22 is a partial side sectional view of the trim tab assembly of FIG. 17 with the trim tab in an extended position and in an alternate hinge position.

In FIG. 17 the trim tab assembly 110 is shown having a scraper plate 187. The curved face 140 of the trim tab 120 is adjacent to and is moved relative to the scraper plate 187. The scraper plate 187 is adjacent a member 189 and the curved surface 140. The member 189 and the curved surface 140 moves relative to the scraper plate 187 while transitioning between retracted and extended states. The scraper plate 187 extends parallel to and along the curved face 140 of the member 189. The member 189 and the curved surface 140 have a first portion 191 and a second portion 193. While in an extended state, the first portion 191 does not extend below the scraper plate 187, and the second portion 193 extends below the scraper plate 187. While in a retracted position, the first portion 191 and the second portion 193 of the member 189 and the curved surface 140 do not extend below the scraper plate 187.

The member 189 and the curved surface 140 are shaped and a relationship between the member 189 (and the curved surface 140) and the support structure 115 are such that a distance between the member 189 (and the curved surface 140) and the scraper plate 187 remains unchanged during transitioning of the member 189 (and the curved surface 140) between the retracted and extended states. The scraper plate 187 extends away from a hull of a marine vessel and towards the member 189 (and the curved surface 140). While in the extended state (i) the member 189 (and the curved surface 140) extend partially below the scraper plate 187, (ii) at least a portion of the member 189 (and the curved surface 140) is not below the scraper plate 187, and (iii) the member 189 (and the curved surface 140) extend at least from a first point 195, adjacent the scraper plate 187, to a second point 197 below and rearward of the scraper plate 187. This can be seen best in FIG. 48.

Figure 23:
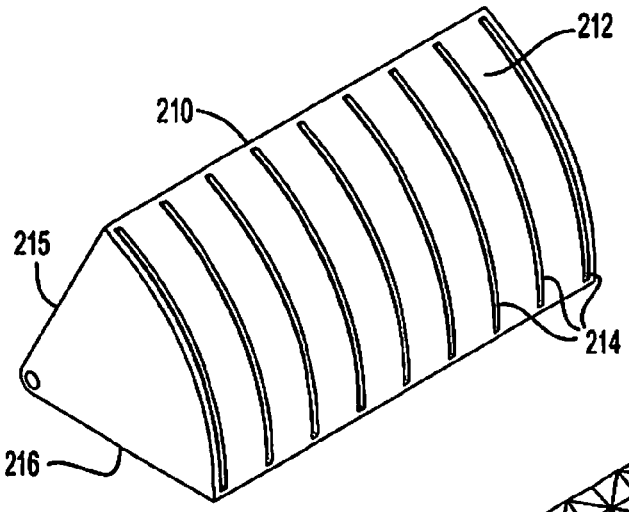
FIG. 23 is a perspective view of a trim tab having slits in a curved surface.
Figure 24:
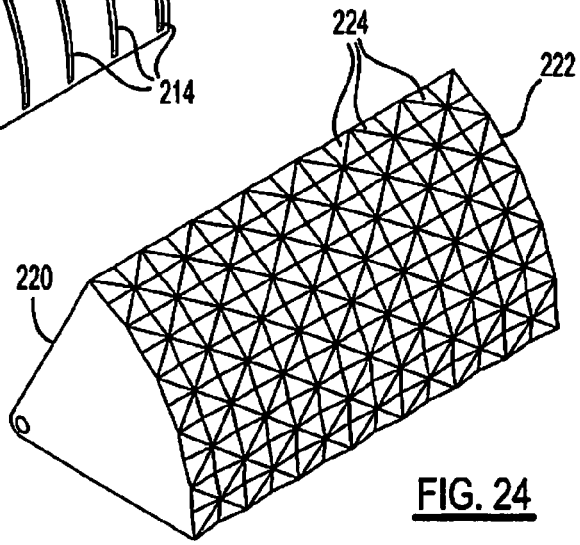
FIG. 24 is a perspective view of a trim tab having a diamond surface formed thereon.

In FIG. 23, a trim tab 210 is shown having a curved surface (or face) 212 with slits 214. The slits 214 are spaced away from each other and extend parallel to each other. The slits 214 extend between a top surface 215 and a bottom surface 216 of the trim tab 210. In FIG. 24, a trim tab 220 is shown having a curved face 222. The curved face 222 is a diamond face having triangular-shaped sections 224. Portions of the triangular-shaped sections protrude from the trim tab 220 more than other portions of the triangular-shaped sections.

Figure 25:
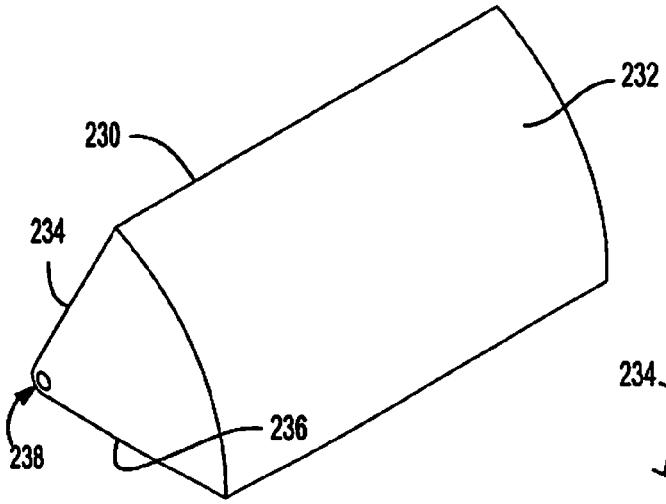
FIG. 25 is a perspective view of a trim tab having an eccentric curved surface.
Figure 26:
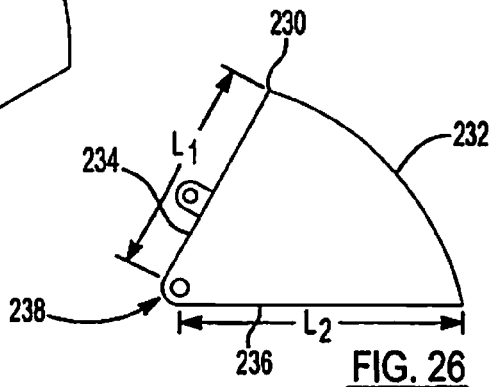
FIG. 26 is a side view of the embodiment of FIG. 25.

In FIGS. 25-26, a trim tab 230 is shown having an eccentric curved surface (or face) 232. The trim tab 230 includes a top surface 234 and a bottom surface 236. The top surface 234 and the bottom surface 236 extend from a hinge location 238 to the eccentric curved face 232. The top surface has a first length $L_1$ between the hinge location 238 and the eccentric curved face 232 that is shorter than a second length $L_2$ of the bottom surface between the hinge location 238 and the eccentric curved surface 232. The surfaces 234, 236 are not symmetrical for at least the reason that the surfaces 234, 236 have the different lengths $L_1$, $L_2$.

Figure 27:
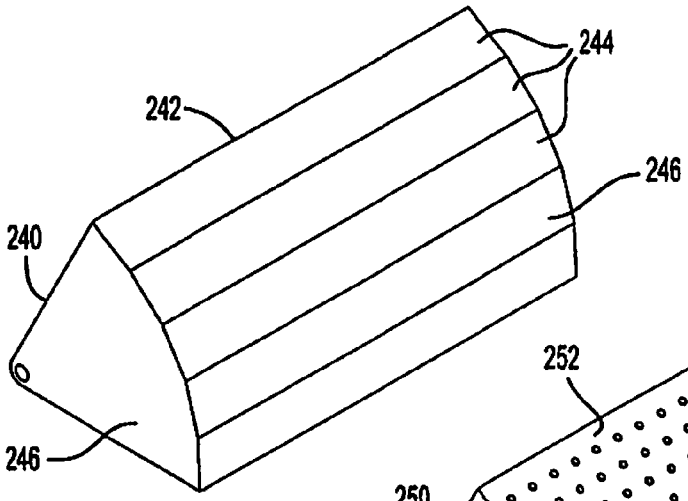
FIG. 27 is a perspective view of a trim tab having facets formed thereon.
Figure 28:
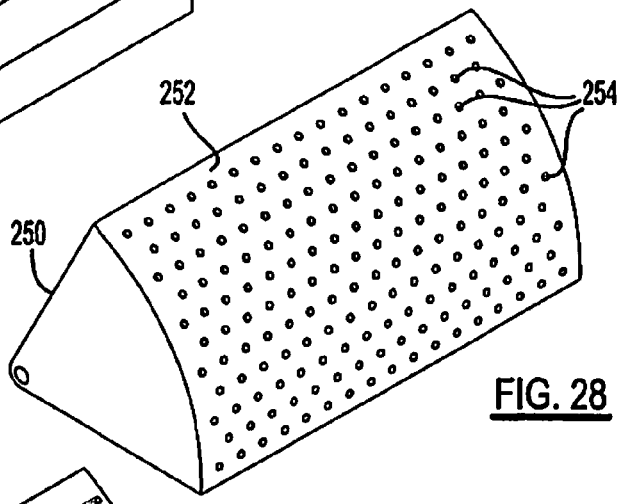
FIG. 28 is a perspective view of a trim tab having holes formed in a curved surface.

In FIG. 27, a trim tab 240 is shown having a curved faceted surface (or face) 242. The curved faceted face 242 has flat rectangular sections 244 that extend laterally between sides 246 of the trim tab 240. The flat rectangular sections extend in parallel to each other. In FIG. 28, a trim tab 250 is shown having a curved face 252. The curved face 252 has holes 254 and thus is perforated. Inclusion of the holes 254 increases surface area of the trim tab 250.

Figure 29:
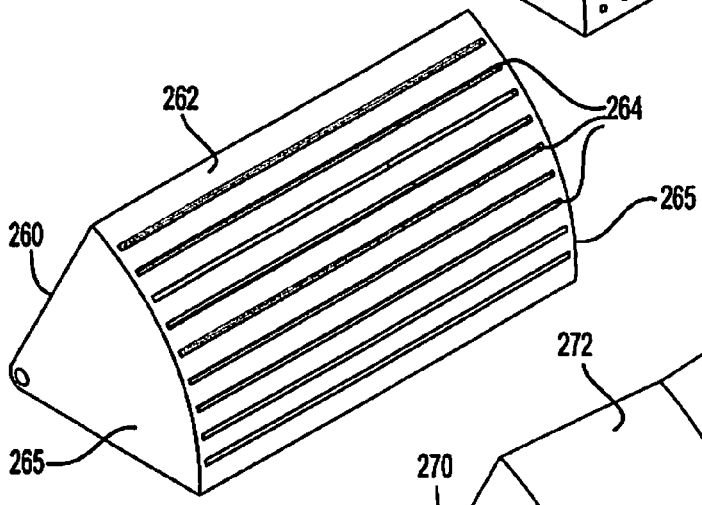
FIG. 29 is a perspective view of a trim tab having horizontal slits formed in a curved surface.

In FIG. 29, a trim tab 260 is shown having a curved surface (or face) 262 with horizontal slits 264. The horizontal slits 264 are spaced away from each other and extend parallel to each other and between sides 265 of the trim tab 260.

Figure 30:
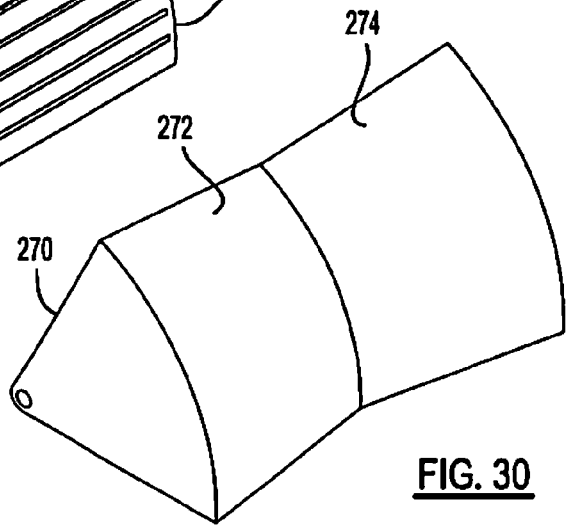
FIG. 30 is a perspective view of a trim tab having multiple curved surfaces to provide an inward protruding inverted plow face.
Figure 31:
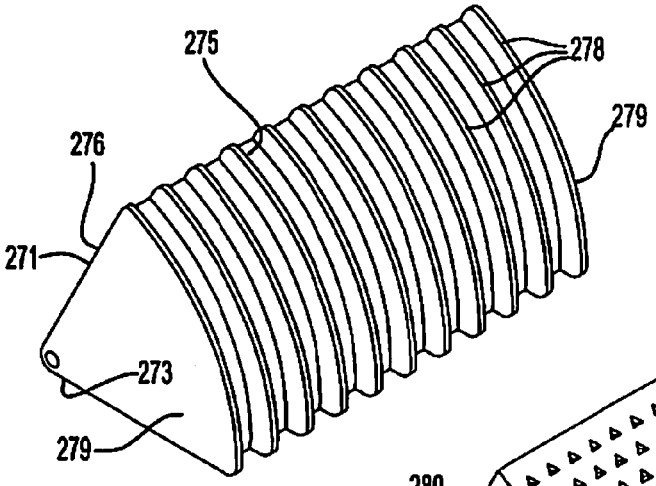
FIG. 31 is a perspective view of a trim tab having multiple fences formed thereon.
Figure 32:
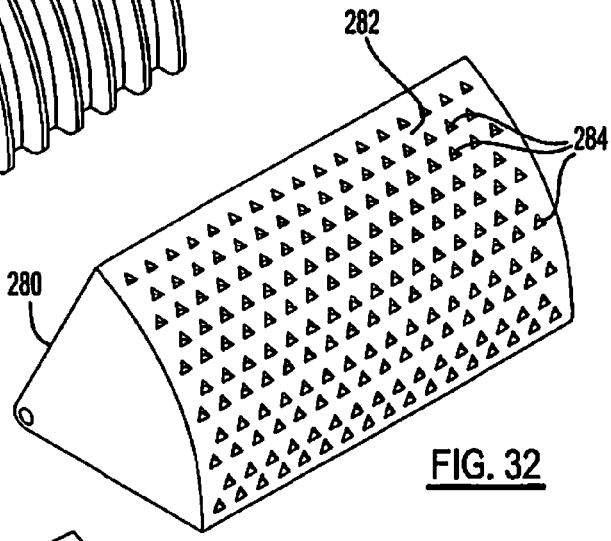
FIG. 32 is a perspective view of a trim tab having triangular holes formed in a curved surface.
Figure 33:
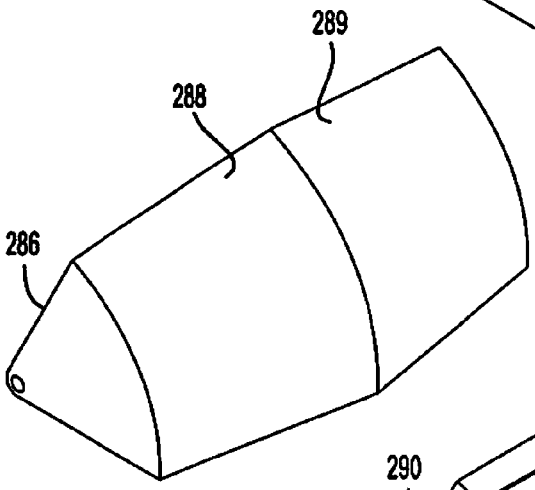
FIG. 33 is a perspective view of a trim tab having multiple curved surfaces to provide an outward protruding inverted plow face.

In FIG. 30, a trim tab 270 is shown having two curved surfaces (or faces) 272, 274. The curved faces 272, 274 provide an inward protruding inverted plow face. In FIG. 31, a trim tab 276 is shown having a curved surface (or face) 275 with multiple fences 278. The fences extend between a top surface 271 and a bottom surface 273 of the trim tab 270. The fences 278 protrude from the curved face 275. The fences 278 extend parallel to each other. Sides 279 of the trim tab 276 may extend past the curved face 275 to provide two of the fences, as shown. In FIG. 32, a trim tab 280 is shown having a curved surface (or face) 282. The curved face 282 has triangular shaped-holes 284 and thus is perforated. In FIG. 33, a trim tab 286 is shown having two curved faces 288, 289. The curved faces 288, 289 provide an outward protruding inverted plow face.

Figure 34:
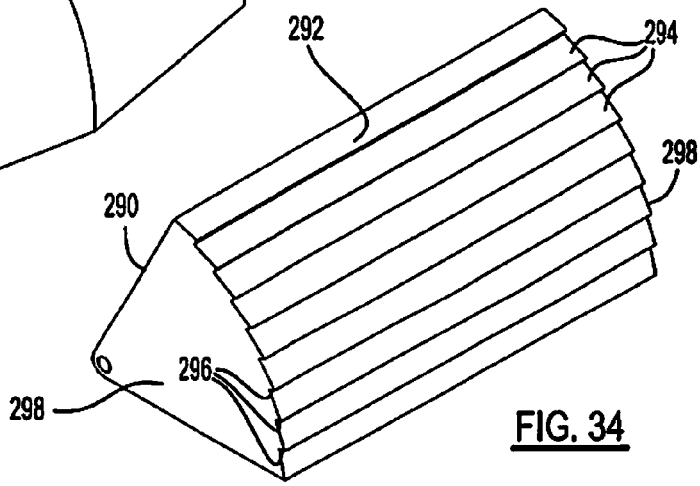
FIG. 34 is a perspective view of a trim tab having a stepped surface.
Figure 35:
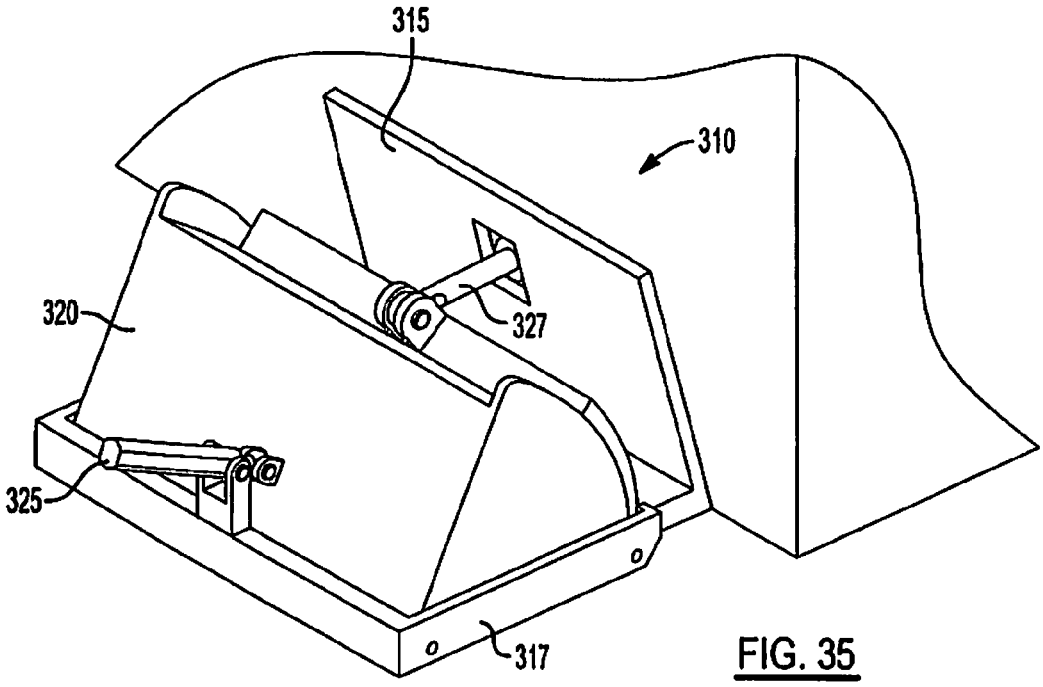
FIG. 35 is a perspective view of another alternative embodiment of a trim tab assembly having a pivotally moveable trim tab mounting frame and actuator with the trim tab and mounting frame in a non-actuated position.
Figure 36:
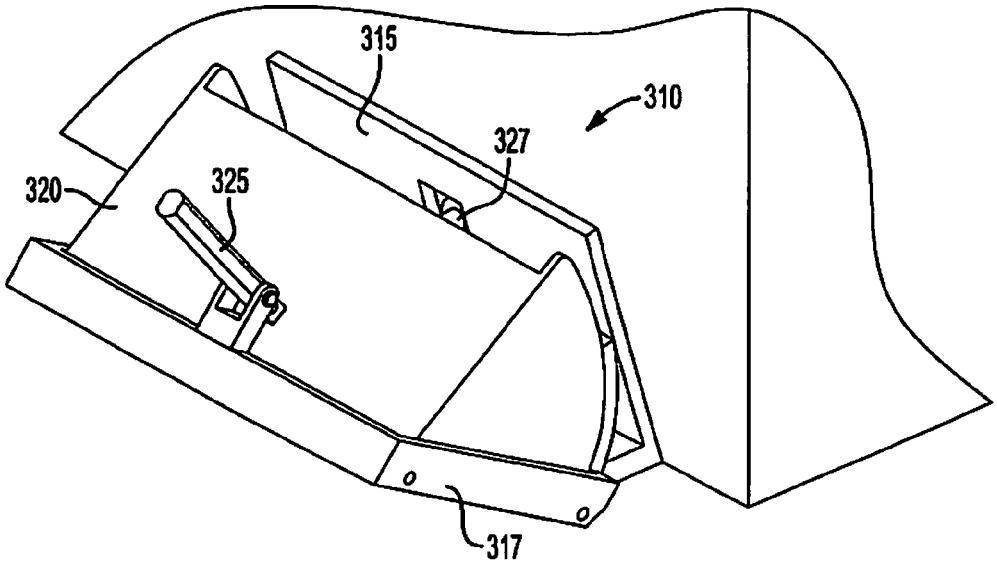
FIG. 36 is a perspective view of the trim tab assembly of FIG. 35 with the trim tab in a non-actuated position and the mounting frame in an actuated position.
Figure 37:
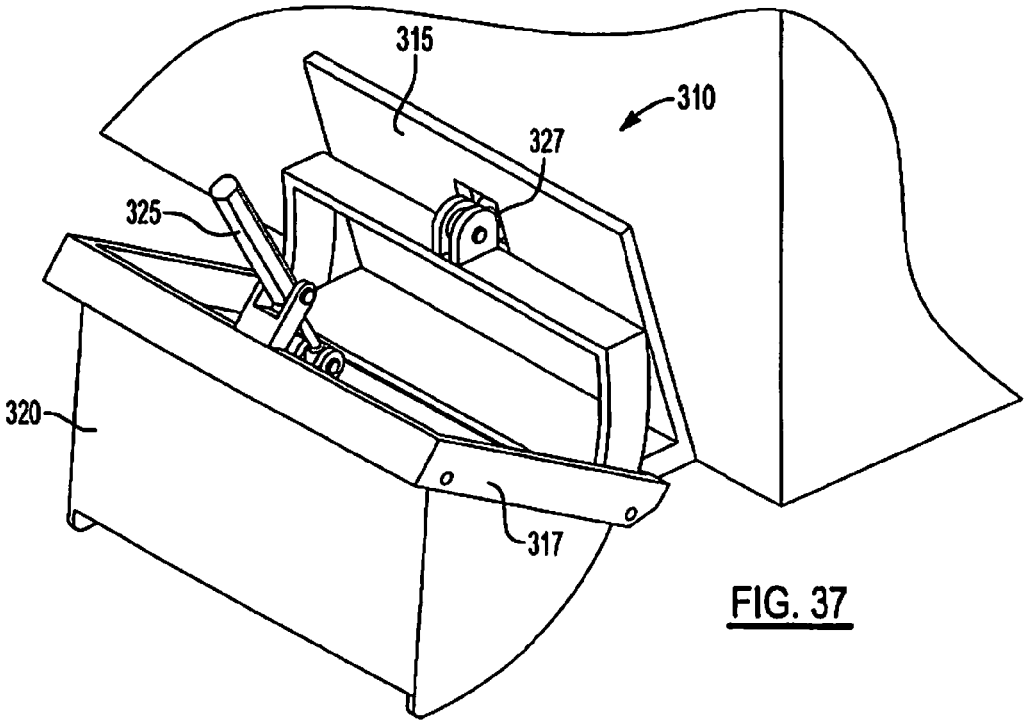
FIG. 37 is a perspective view of the trim tab assembly of FIG. 35 with the trim tab in an actuated position and the mounting frame in a non-actuated position.
Figure 38:
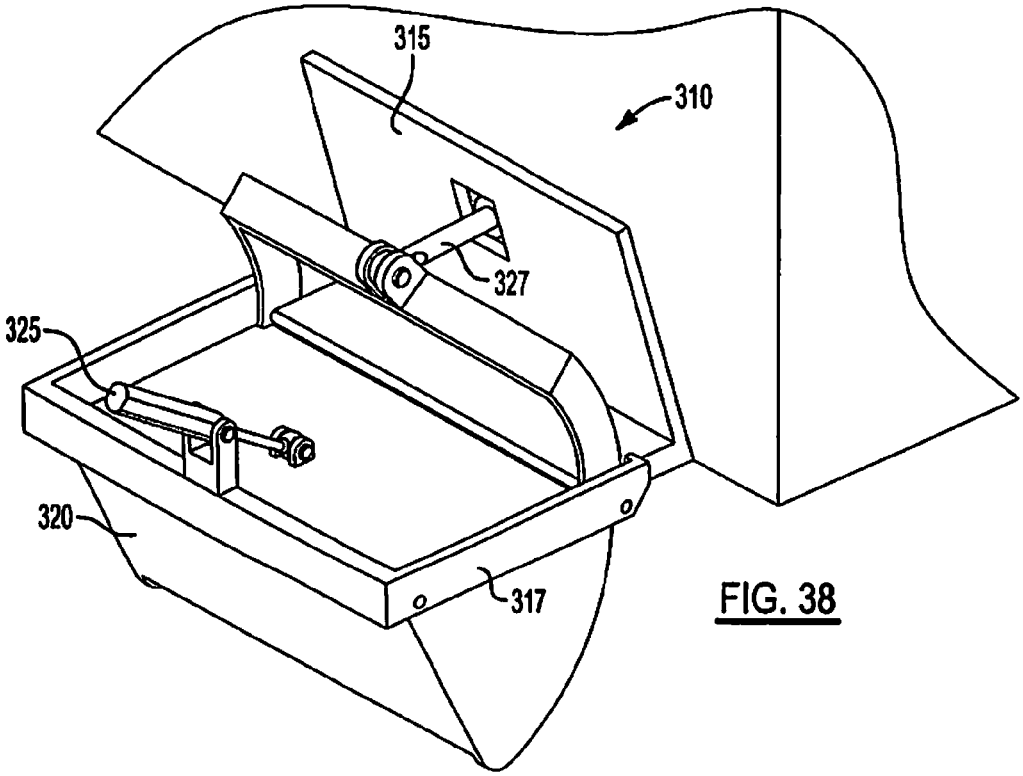
FIG. 38 is a perspective view of the trim tab assembly of FIG. 35 with the trim tab in an actuated position and the mounting frame in an actuated position.
Figure 39:
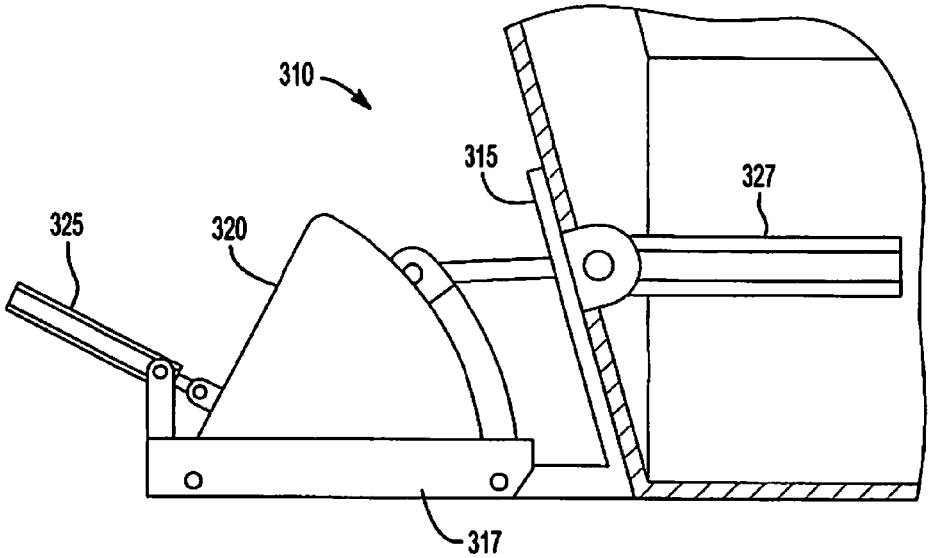
FIG. 39 is a side view of the trim tab assembly of FIG. 35 with the trim tab and the mounting frame in a non-actuated position.
Figure 40:
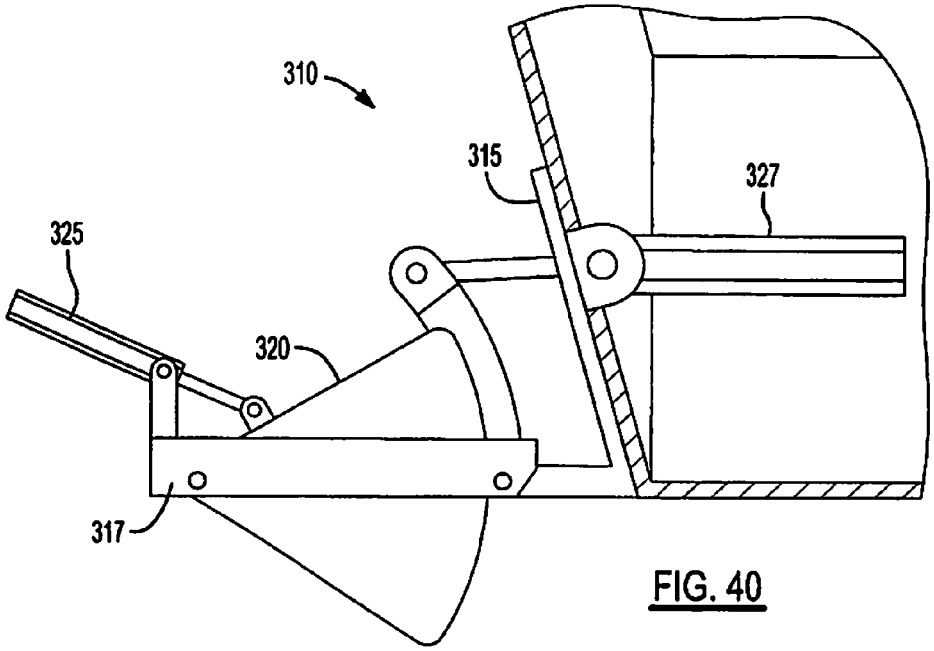
FIG. 40 is a side view of the trim tab assembly of FIG. 35 with the trim tab in a non-actuated position and the mounting frame in an actuated position.
Figure 41:
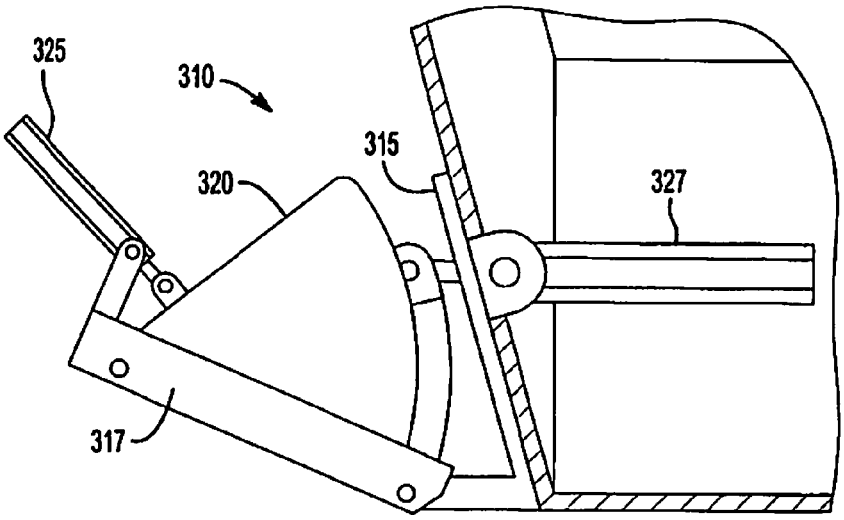
FIG. 41 is a side view of the trim tab assembly of FIG. 35 with the trim tab in an actuated position and the mounting frame in a non-actuated position.
Figure 42:
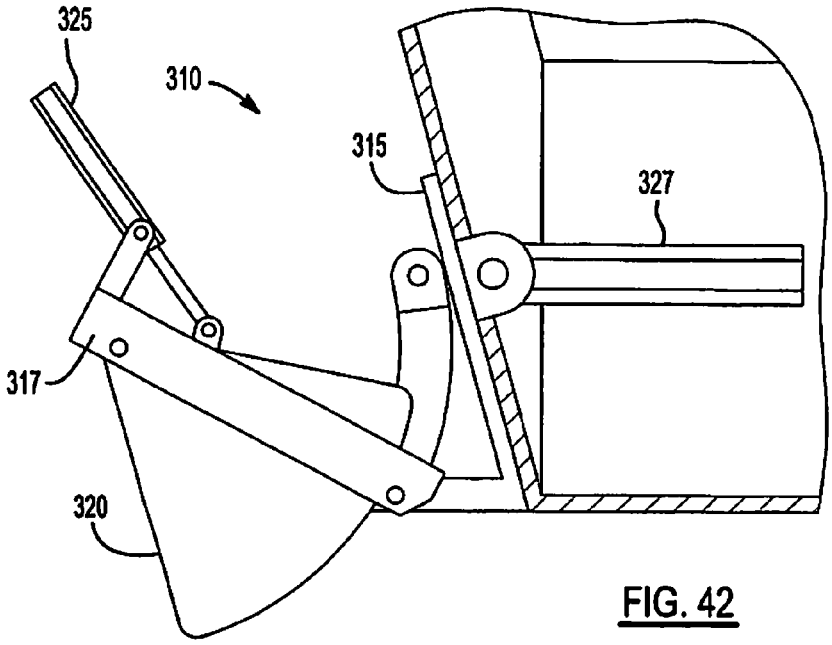
FIG. 42 is a side view of the trim tab assembly of FIG. 35 with the trim tab in an actuated position and the mounting frame in an actuated position.

In FIG. 34, a trim tab 290 is shown having a stepped curved surface (or face) 292. The stepped curved face 292 has rectangular sections 294 that are stepped relative to each other providing side edges 296 that protrude from the trim tab 290. The rectangular sections 294 extend laterally across the stepped curved face 292 between sides 298 of the trim tab 290.

Referring again to FIG. 17, in one aspect, the curved surface 140 may include perforations formed therein or having various shapes and configurations, as shown in FIGS. 23-34. Referring to FIGS. 23-34, various perforations may include small holes of varying shape, slits of varying direction, and other slots or holes to modify the contact surface or curved surface 140 of the trim tab 120. Additionally, the curved surface 140 may include shapes formed thereon including facets, strakes, multiple curved surfaces, steps, curves that may vary, fence structures and mirrored curved surfaces. In this manner, the performance characteristics and contact area of the trim tab 120 may be adjusted for various types of watercraft.

Figure 44:
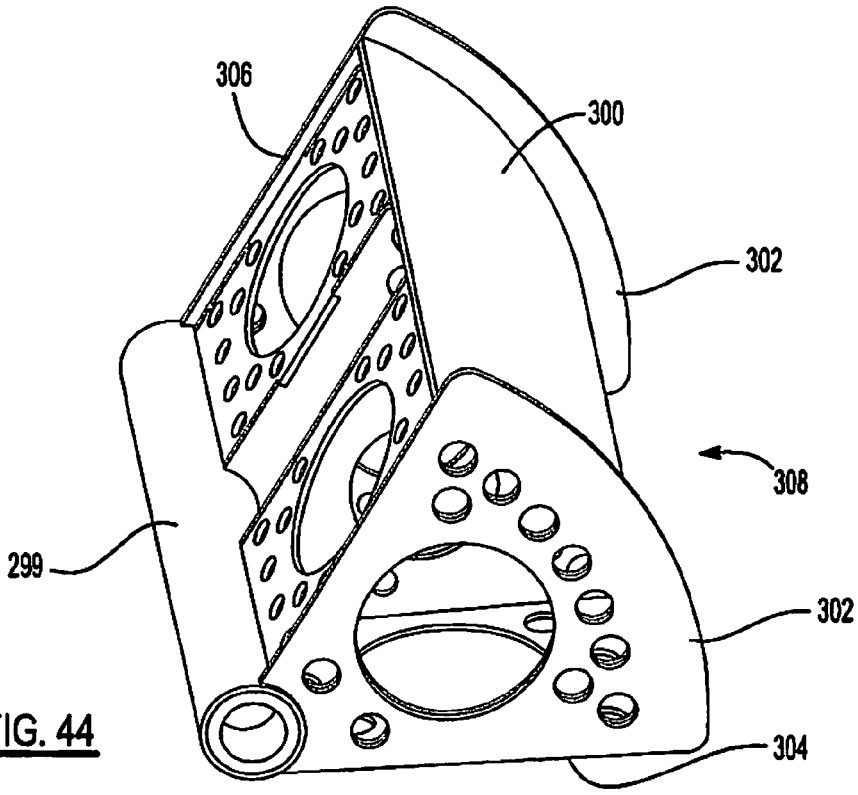
FIG. 44 is a side perspective view of another trim tab with perforated sides and pressure fencing tabs.
Figure 45:
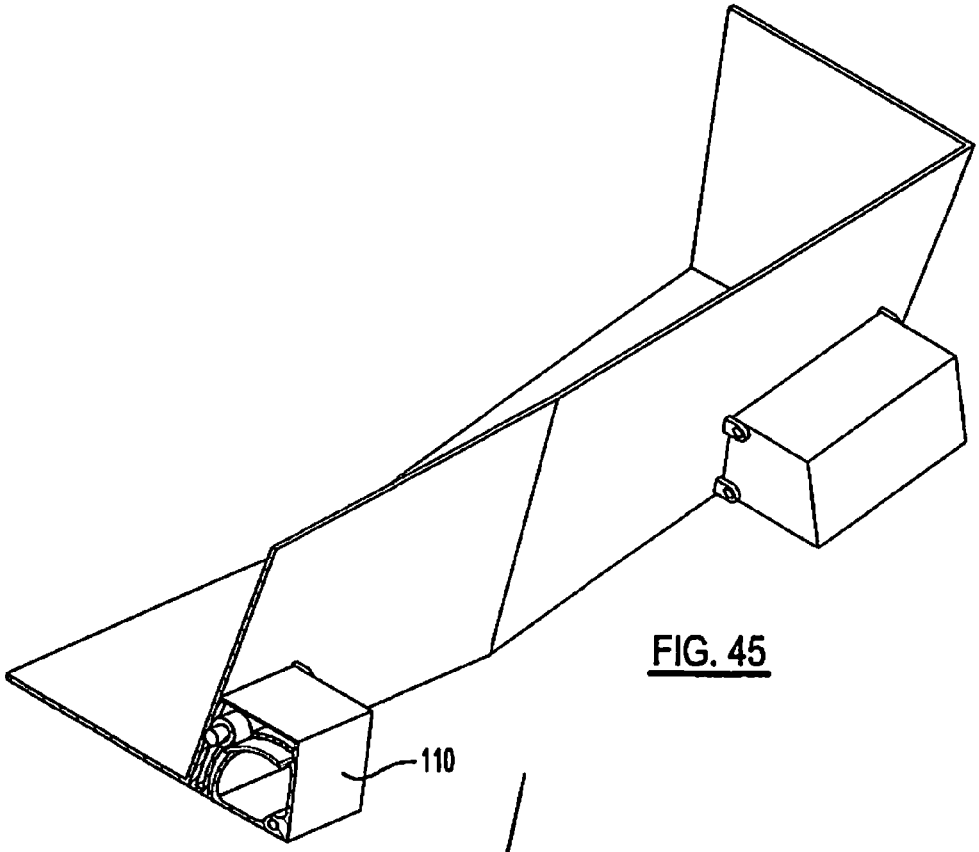
FIG. 45 is a perspective view of the trim tab assembly mounted externally to the hull transom.
Figure 46:
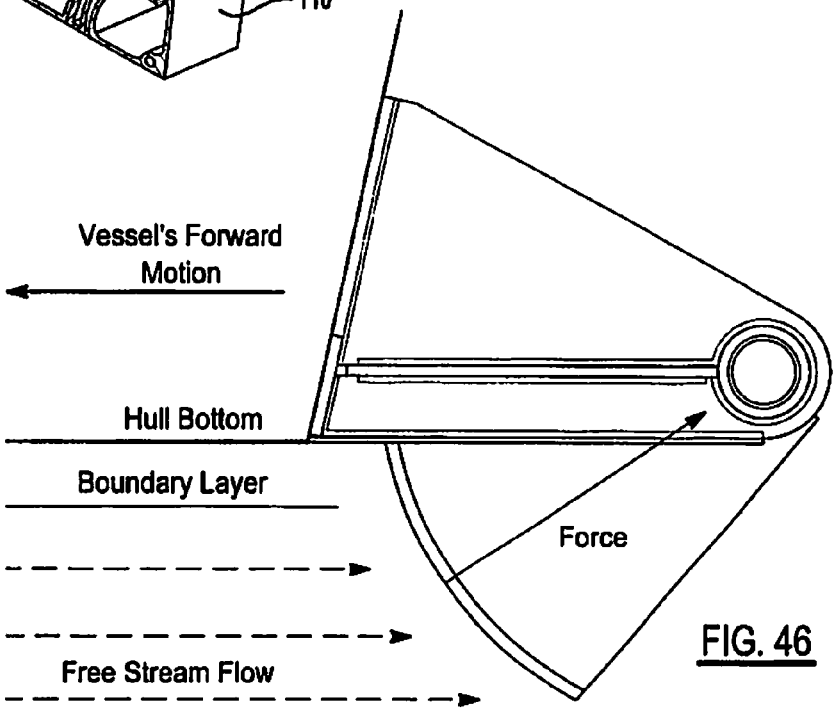
FIG. 46 is a diagram detailing a force applied to the hinge of the trim tab assembly.

In another aspect as shown in FIG. 44, a trim tab 299 is shown having a curved face 300 and may include strakes or fencing 302 formed as part of sides 304, 306 of the trim tab 299 to contain high-pressure water and prevent lateral migration of water from the curved surface 300. The trim tab 299 may replace the trim tab 120 of FIG. 17. In this manner, lateral stability of the watercraft may be improved. Containing high-pressure water with strakes or fencing may also improve the efficiency of the trim tab 299. The strakes or fencing 302 may extend away from the curved surface 300, as shown, providing a channel 308 external to the trim tab 299 and between the strakes or fencing 302.

Figure 43:
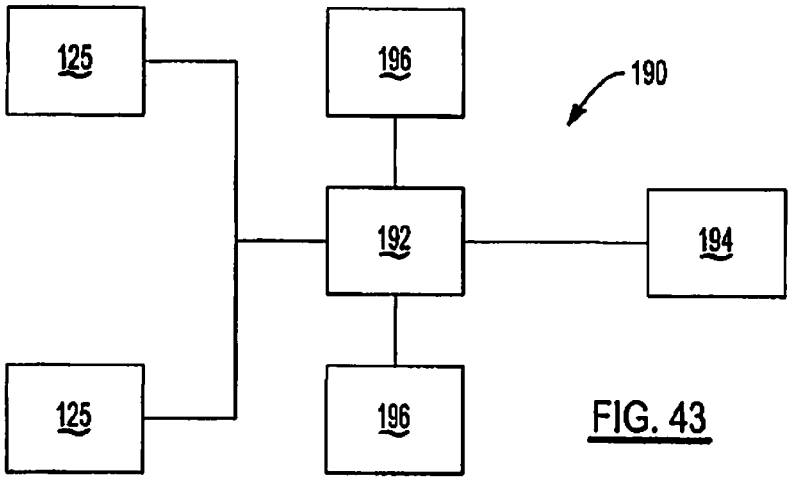
FIG. 43 is a diagram of a control system of the trim tab assembly.

As previously stated above, the trim tab 120 of FIG. 17 may be actuated at speeds sufficient to counter motion rates and damp motion in the pitch, roll and yaw axes of a vessel or watercraft. In one aspect, the trim tab 120 may be actuated to control attitude changes in the pitch, roil and yaw axes of the watercraft. The trim tab assembly 110 may be coupled to an active stabilization motion damping and attitude control system 190 linked with the actuator 125 controlling movement of the trim tab 120, as best seen in FIG. 43. The active stabilization motion damping and attitude control system 190 may include a controller 192 that has appropriate hardware and programming to decide on the positioning of the trim tabs 120. The controller 192 is connected with the actuators 125.

The controller 192 may also be connected with sensors 194 that detect a position and characteristics of the water craft such as a steering position or a rudder position. The controller 192 may also be coupled with various input and output devices 196 such as a touch screen, buttons, steering controls, throttle, displays, speakers or other types of devices.

Various numbers of the trim tab assembly 110 may be included on the watercraft and in various positions such as forward or aft on a vessel or internal (in a cavity) or external to the hull. In one aspect, at least two of the trim tab assembly 110 are connected on the watercraft such that the trim tab assemblies are actuated in series or differentially to impart various changes in the pitch, roll and yaw axes of the watercraft.

In one aspect, the active stabilization, motion damping, and attitude control system 190 may include various protocols for moving the trim tab 120 of the trim tab assembly 110. For example, the control system 190 may include an auto park feature for beaching and trailing such that the trim tab 120 is retracted when the watercraft speed is below a specified level such as 5 knots for example. Such integration may include a throttle position sensor for determining whether the vessel is slowing, stopping and/or reversing. Additionally, the control system 190 may include other features to control the trim tabs 120 as a watercraft or vessel exits the water during high-speed operation. For example, the control system 190 including sensors 196 may detect a change of the vessel attitude or position and retract the trim tab(s) 120 to avoid damage to the trim tab(s) 120, the hinge assembly 100, and actuator assembly 125 due to high load forces that may be incurred as the vessel reenters the water.

The trim tab assembly 110 may be positioned at various locations on a watercraft. In one aspect, the trim tab assembly 110 may be positioned on a transom and is attached to a hull of the watercraft. In another aspect, as shown in FIGS. 19-22, the support structure 115 and trim tab 120 may be positioned within a cavity 200 formed in a watercraft hull. In one aspect, the cavity 200 may include a snorkel opening formed therein for equalizing a pressure within the cavity in response to trim tab actuation.

Referring to FIGS. 35-42, another alternative embodiment of a trim tab assembly 310 for a watercraft is shown. The trim tab assembly 310 may include a support structure 315 attached to the watercraft. A trim tab mounting frame 317 may be pivotally attached to the support structure 315. At least one trim tab 320 is pivotally attached to the trim tab mounting frame 317. A first actuator 325 is connected to the trim tab 320 pivotally moving the trim tab 320 relative to the trim tab mounting frame 317. A second actuator 327 is connected to the trim tab mounting frame 317 pivotally moving the trim tab mounting frame 317, where an angle of deflection of the trim tab 320 relative to ambient water flow is adjusted.

As with the previously described embodiment of FIGS. 17-22, the at least one trim tab 320 includes a trim tab frame 315 having a curved surface 340 positioned to contact water when the watercraft is in motion. Additionally, the actuator 325 may include linear actuators connected directly to the trim tab frame 315 or may include rotary actuators as described above. The trim tab frame 315 may include the hinge structure as described above. Additionally, the trim tab frame 315 may include the top, bottom, and side surfaces linked by the curved surface 340 as described above.

The trim tab assembly of FIGS. 35-42 may also include a control system 190 as described above. In one aspect, the control system 190 may actuate the trim tab 340 and trim tab support frame 317 at speeds sufficient to counter motion rates and damp motion in the pitch, roll and yaw axes of the vessel or watercraft. The control system 190 may actuate the trim tab 320 as well as adjust the angle of the trim tab relative to ambient water by changing the position of the trim tab support frame 317. In this manner, various geometries or positions of a trim tab 320 relative to the watercraft hull and flow of ambient water may be automatically accomplished to optimize the overall watercraft or vessel performance.

While the trim tab assemblies have been described with respect to a watercraft or vessel, it should be realized that the trim tab assemblies 110, 310 may be integrated as a control surface within a wing or similar lifting body for aerospace applications.

Figure 47:
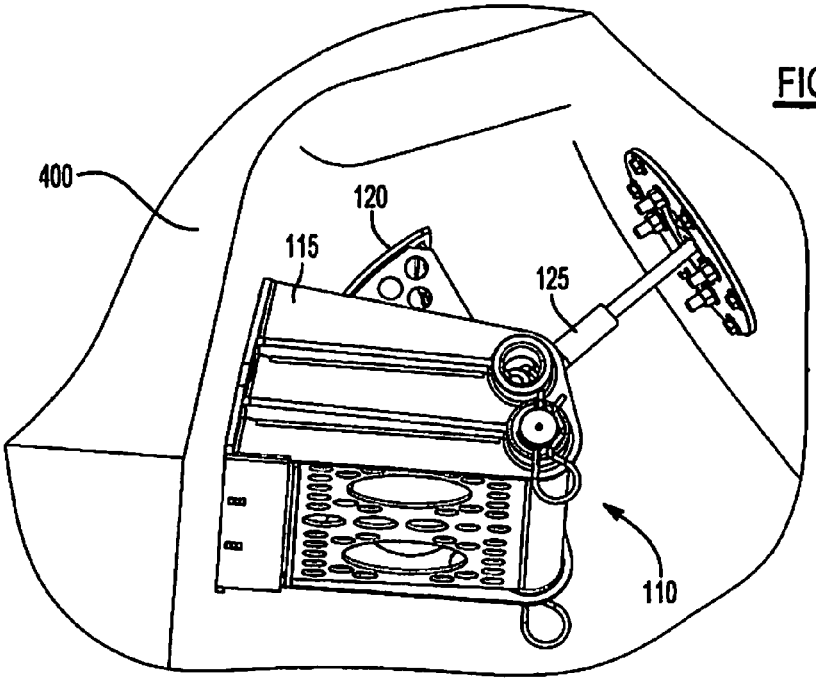
FIG. 47 is a perspective view of the trim tab assembly mounted on a watercraft with a trim tab in a retracted position.
Figure 48:
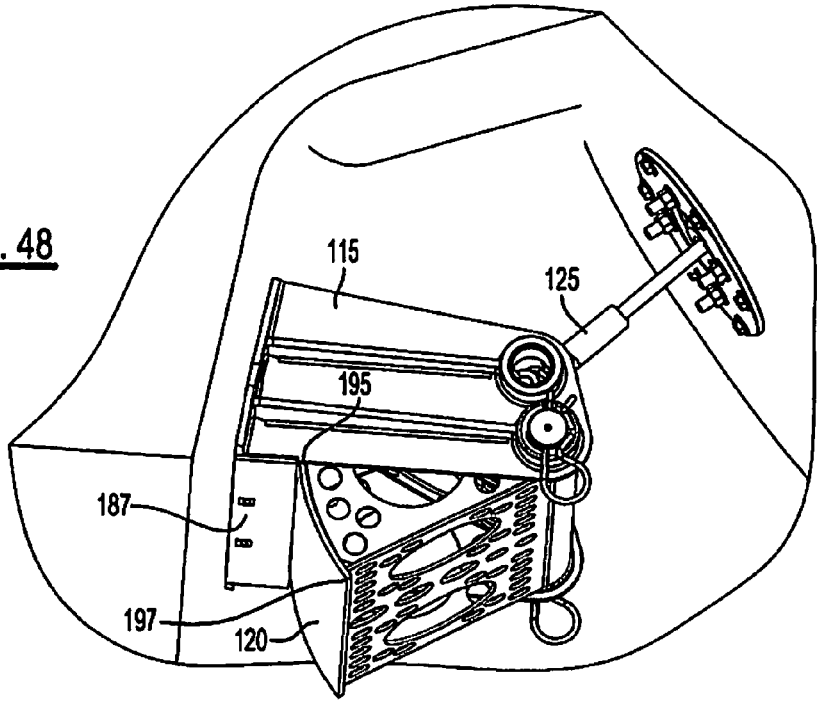
FIG. 48 is a perspective view of the trim tab assembly of FIG. 47 with the trim tab in a partially extended position.
Figure 49:
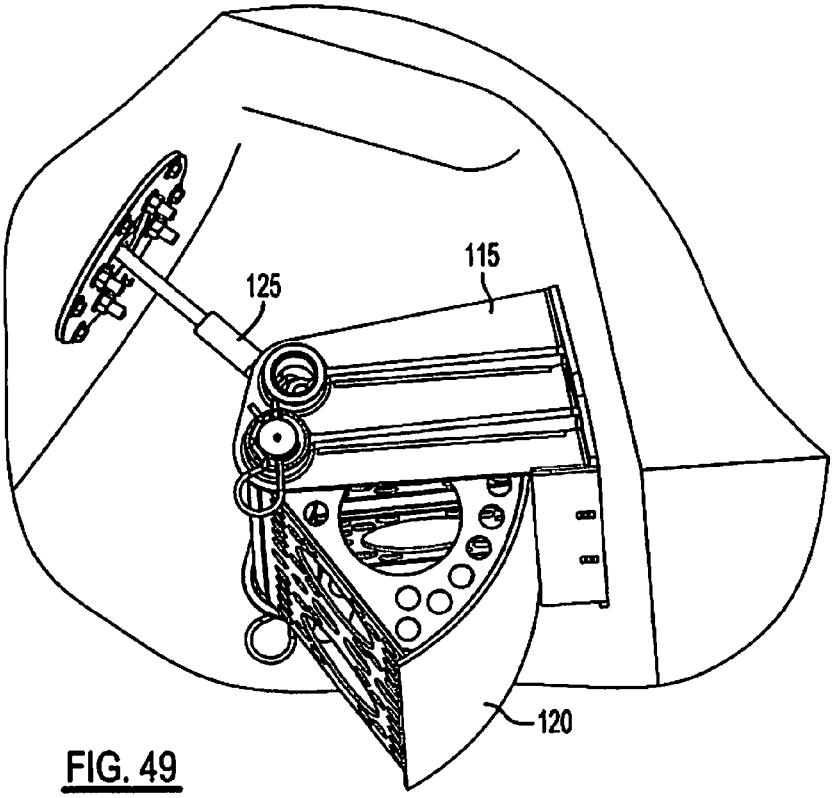
FIG. 49 is a perspective view of the trim tab assembly of FIG. 47 with the trim tab in an extended position.

FIGS. 47-49 show perspective views of a trim tab assembly 110 mounted on a watercraft 400 with the trim tab 120 in retracted, partially extended, and fully extended positions. The trim tab assembly 110 is shown as including the support structure 115 and the actuator 125.

The invention claimed is:

1. A trim tab assembly comprising:

a trim tab comprising a first end comprising at least one of a member or a curved surface, wherein the member or the curved surface, when in an extended state, adjusts attitude or motion of a marine vessel; and a second end that attaches to the marine vessel via an attachment device, wherein the member or the curved surface is convex-shaped such that the member or the curved surface curves outward in a direction away from the attachment device while the second end is attached to the marine vessel; and a support structure that attaches to the marine vessel, wherein the support structure comprises a scraper plate, wherein the scraper plate is adjacent to the member or the curved surface, and wherein the member or the curved surface moves relative to the scraper plate while transitioning between a retracted state and the extended state and while the support structure is attached to the marine vessel.

2. The trim tab assembly of claim 1, wherein the second end is positioned rearward of the first end when attached to the marine vessel.

3. The trim tab assembly of claim 1, wherein the member or the curved surface, when in the extended state, adjusts pitch, roll or yaw attitude or motion of the marine vessel.

4. The trim tab assembly of claim 1, comprising the member, wherein:

the member comprises the curved surface; and the scraper plate extends parallel to and along the curved surface of the member.

5. The trim tab assembly of claim 1, wherein:

the member or the curved surface has a first portion and a second portion; and while in the extended state, (i) the first portion does not extend below the scraper plate, and (ii) the second portion extends below the scraper plate.

6. The trim tab assembly of claim 5, wherein, while in the retracted state, the first portion and the second portion of the member or the curved surface do not extend below the scraper plate.

7. The trim tab assembly of claim 1, wherein a relationship between the member or the curved surface and the support structure are such that a distance between the member or the curved surface and the scraper plate remains unchanged during transitioning of the member or the curved surface between the retracted state and the extended state.

8. The trim tab assembly of claim 1, wherein the scraper plate extends away from a hull of the marine vessel and towards the member or the curved surface.

9. The trim tab assembly of claim 1, while in the extended state:

the member or the curved surface extends partially below the scraper plate;

at least a portion of the member or the curved surface is not below the scraper plate; and the member or the curved surface extends at least from a first point, adjacent the scraper plate, to a second point below and rearward of the scraper plate.

10. A trim tab comprising:

a member connected to and positioned at least partially forward of an attachment device, wherein the member rotates at least partially about a portion of the attachment device between a retracted state and an extended state to adjust attitude or motion of a marine vessel;

a first end comprising a first portion and a second portion; and a second end, wherein the first end is positioned forward of the second end, the second portion of the first end extends forward of the first portion of the first end and away from the second end, and while in the extended state, the first end extends at least from a first point, adjacent a scraper plate or a bottom surface of the marine vessel, to a second point below the scraper plate or the bottom surface of the marine vessel.

11. The trim tab of claim 10, wherein:

the second end is positioned rearward of the first end;

the member is forward facing when the trim tab is attached to the marine vessel; and the member is convex-shaped, such that the member curves outward in a direction away from the attachment device.

12. A trim tab comprising:

a first end comprising a first member, wherein the first member has a first curved surface;

a second end that attaches to a marine vessel via an attachment device, and wherein the first end adjusts attitude or motion of the marine vessel while the second end is attached to the marine vessel; and a side extending between the first member and the attachment device, wherein the first curved surface and the side define a wedge-shaped portion of the trim tab, wherein the first member is pivoted about a portion of the attachment device and extends below a scraper plate while in an extended state.

13. A trim tab comprising:

a first end comprising a first member, wherein the first member has a first curved surface;

a second end that attaches to a marine vessel via an attachment device, and wherein the first end adjusts attitude or motion of the marine vessel while the second end is attached to the marine vessel; and a side extending between the first member and the attachment device, wherein the first curved surface and the side define a wedge-shaped portion of the trim tab, wherein the first member is pivoted about a portion of the attachment device and extends below a scraper plate or a second surface of the marine vessel while in an extended state the second end is positioned rearward of the first end, and the first curved surface is forward facing when the trim tab is attached to the marine vessel.

14. A trim tab comprising:

a first end comprising a first member, wherein the first member has a first curved surface;

a second end that attaches to a marine vessel via an attachment device, and wherein the first end adjusts attitude or motion of the marine vessel while the second end is attached to the marine vessel; and a side extending between the first member and the attachment device, wherein the first curved surface and the side define a wedge-shaped portion of the trim tab, wherein the first member is pivoted about a portion of the attachment device and extends below a scraper plate or a second surface of the marine vessel while in an extended state, and the first surface of the first member is convex-shaped, such that the first surface curves outward in a direction away from the attachment device.

15. A trim tab comprising:

a first end comprising a first member, wherein the first member has a first curved surface;

a second end that attaches to a marine vessel via an attachment device, and wherein the first end adjusts attitude or motion of the marine vessel while the second end is attached to the marine vessel; and a side extending between the first member and the attachment device, wherein the first curved surface and the side define a wedge-shaped portion of the trim tab, wherein the first member is pivoted about a portion of the attachment device and extends below a scraper plate or a second surface of the marine vessel while in an extended state the first member comprises a second plate and includes a third end and a fourth end, wherein the first curved surface extends from the third end to the fourth end, and the side is a third plate.

16. A trim tab comprising:

a first end comprising a first member, wherein the first member has a first curved surface;

a second end that attaches to a marine vessel via an attachment device, and wherein the first end adjusts attitude or motion of the marine vessel while the second end is attached to the marine vessel; and a side extending between the first member and the attachment device, wherein the first curved surface and the side define a wedge-shaped portion of the trim tab, wherein the first member is pivoted about a portion of the attachment device and extends below a scraper plate or a second surface of the marine vessel while in an extended state, and wherein (i) the first member comprises a plurality of slits or holes, (ii) the first curved surface has a diamond face (iii) the first curved surface has an eccentric face, (iv) the first curved surface comprises a plurality of strakes or fences, (v) the first curved surface is a faceted face or a stepped face, or (vi) (a) the first member comprises a third surface, and (b) the first curved surface and the third surface together provide an inverted plow face.

17. The trim tab of claim 12, wherein the first curved surface has a diamond face or an eccentric face.

18. The trim tab of claim 12, wherein the first curved surface comprises a plurality of strakes or fences.

19. The trim tab of claim 12, wherein the first curved surface is a faceted face or a stepped face.

20. The trim tab of claim 12, wherein:

the first member comprises a third surface; and the first curved surface and the third surface together provide an inverted plow face.

* * * * *